US007420511B2

(12) United States Patent
Oshiyama et al.

(10) Patent No.: US 7,420,511 B2
(45) Date of Patent: Sep. 2, 2008

(54) ANTENNA FOR A PLURALITY OF BANDS

(75) Inventors: Tadashi Oshiyama, Tomioka (JP); Hirotoshi Mizuno, Tomioka (JP); Yusuke Suzuki, Tomioka (JP)

(73) Assignee: Yokowo Co., Ltd., Tokyo (JP)

( * ) Notice: Subject to any disclaimer, the term of this patent is extended or adjusted under 35 U.S.C. 154(b) by 102 days.

(21) Appl. No.: 10/534,258

(22) PCT Filed: Nov. 10, 2003

(86) PCT No.: PCT/JP03/14250

§ 371 (c)(1),
(2), (4) Date: May 10, 2005

(87) PCT Pub. No.: WO2004/047223

PCT Pub. Date: Jun. 3, 2004

(65) Prior Publication Data

US 2006/0097918 A1 May 11, 2006

(30) Foreign Application Priority Data

Nov. 18, 2002 (JP) ..... 2002-333920

(51) Int. Cl.
*H01Q 1/38* (2006.01)

(52) U.S. Cl. ..... 343/700 MS; 343/846

(58) Field of Classification Search ..... 343/700 MS, 343/741, 744, 745, 749, 829, 846, 867, 702, 343/770–776, 820, 895
See application file for complete search history.

(56) References Cited

U.S. PATENT DOCUMENTS 5,754,143 A * 5/1998 Warnagiris et al. ..... 343/767
5,790,080 A * 8/1998 Apostolos ..... 343/744
6,204,819 B1 * 3/2001 Hayes et al. ..... 343/702
6,255,994 B1 * 7/2001 Saito ..... 343/700 MS (Continued)

FOREIGN PATENT DOCUMENTS

JP 05-243834 A 9/1993

(Continued)

*Primary Examiner*—Douglas W. Owens
*Assistant Examiner*—Jimmy Vu
(74) *Attorney, Agent, or Firm*—Birch, Stewart, Kolasch & Birch, LLP

(57) ABSTRACT

The present invention provides an antenna for multiple bands employing a single antenna element 10, capable of operating in multiple frequency bands, and ideal for size reduction purposes. One end A of an antenna element 10 is electrically connected to a feeding point 12 and intermediate points B and C and the other end thereof is electrically connected via switches SWb, SWc, and SWd to a ground conductor 14. The electrical lengths of the antenna element 10 from the terminal to the intermediate points B and C plus connection lines from these points via the switches SWb and SWc to the ground conductor 14 and the electrical length from the one end A to the other end D plus a connection line from the other end via the switch SWd to the ground conductor 14 are set to be capable of resonating different desired frequency bands. By closing one of the switches SWb, SWc, and SWd, one of the desired frequencies can be selected and the antenna can resonate with that frequency. Thus, the antenna employing the single antenna element 10 can operate in multiple frequency bands.

20 Claims, 16 Drawing Sheets

U.S. PATENT DOCUMENTS

| | | | | |
|---|---|---|---|---|
| 6,388,626 | B1 * | 5/2002 | Gamalielsson et al. | 343/702 |
| 6,486,844 | B2 * | 11/2002 | Thursby et al. | 343/711 |
| 6,567,047 | B2 * | 5/2003 | Kuck | 343/700 MS |
| 6,963,308 | B2 * | 11/2005 | Korva | 343/700 MS |
| 7,039,437 | B2 * | 5/2006 | Kojola et al. | 455/550.1 |

FOREIGN PATENT DOCUMENTS

| | | | |
|---|---|---|---|
| JP | 05-347507 | A | 12/1993 |
| JP | 8-321716 | A | 12/1996 |
| JP | 09-307344 | A | 11/1997 |
| JP | 10-224142 | A | 8/1998 |
| JP | 11-112219 | A | 4/1999 |
| JP | 11-136025 | A | 5/1999 |
| JP | 2000-40912 | A | 2/2000 |
| JP | 2000-332530 | A | 11/2000 |
| JP | 2001-251128 | A | 9/2001 |
| JP | 2002-261533 | A | 9/2002 |

* cited by examiner

ANTENNA FOR A PLURALITY OF BANDS

TECHNICAL FIELD

The present invention relates to an antenna for multiple bands, employing a single antenna element adapted so it can operate in multiple frequency bands.

BACKGROUND ART

Recent mobile communication has developed rapidly. Among others, mobile phones have proliferated outstandingly and improvements have been made to reduce their size and weight significantly. According to mobile phone standards, two particular frequency bands are used respectively in different regions: in Japan, a 800 MHz band and a 1.5 GHz band for Personal Digital Cellular (PDC); in Europe, a 900 MHz band and a 1.9 GHz band for Global System for Mobile Communications (GSM); and in U.S., a 800 MHz band for Advanced Mobile Phone System (AMPS) and a 1.9 GHz band for Personal Communications System (PCS). Moreover, communication systems such as Global Positioning System (GPS) using 1.5 GHz, Bluetooth using a 2.4 GHz band, and International Mobile Telecommunications (IMT) 2000 using a 2 GHz band are put in practical use for mobile communication and data transmission. If a single antenna is capable of operating in the above-mentioned multiple frequency bands, it would be ideal for the purpose of reducing antenna size and weight.

Furthermore, there is a plan in progress to adopt the GSM that has been used in Europe in U.S. as a mobile phone scheme so that a same mobile phone can be used in U.S. and Europe. However, the GSM in Europe uses a band of 880 to 960 MHz and a band of 1710 to 1880 MHz, whereas the GSM in U.S. is designed to use a band of 824 to 894 MHz and a band of 1850 to 1990 MHz. An antenna capable of operating in the frequency bands in both Europe and U.S. is required to cover both a wide frequency band of 136 MHz ranging from 824 to 960 MHz and a wide frequency band of 280 MHz ranging from 1710 to 1990 MHz.

So far, a single antenna capable of operating in the above multiple frequency bands has not existed. So far, an antenna covering the wide frequency bands so it can operate in the GSM frequency bands in both U.S. and Europe has not existed.

By the way, antennas with reduced size and weight for use in mobile phones have been proposed in Japanese Patent Application Laid-Open (JP-A) No. 2001-284935 and Japanese Patent Application Laid-Open (JP-A) No. 2002-43826. The principles of these techniques will be briefly described below. FIG. 26 shows a basic structure of an antenna of prior art, wherein one end of an antenna element 10 is connected to a feeding point 12 and the other end thereof is electrically connected to a ground conductor 14. The most part of the antenna element 10 is straightened in approximately parallel with the ground conductor 14 except the upright ends for the connections to the feeding point 12 and the ground conductor 14. The entire electrical length of the antenna element 10 is set to ½ wavelength ($\lambda/2$) or 1 wavelength ($\lambda$) of a frequency band in which the antenna operates. Moreover, the antenna element maybe formed in a coil or meandering pattern or appropriately bent into a loop for size reduction purposes. These techniques can be used for only a single frequency band. In FIG. 26, a dotted line denotes current distribution.

FIG. 27 shows another prior art antenna, wherein a capacitor 16 is inserted in series in the center of the antenna element 10 of prior art shown in FIG. 26. The electrical length of the antenna element plus the capacitor 16 is set to ½ wavelength of a frequency band in which the antenna operates. Current distribution denoted by a dotted line in FIG. 27 indicates that an in-phase current is produced in the antenna element 10 and this is effective particularly for a case where antenna directivity is important.

FIG. 28 shows yet another prior art antenna, wherein the capacitor 16 is inserted at a point on the antenna element 10, nearer to the feeding point 12, not in the center, as a modification to the prior art antenna shown in FIG. 27. FIG. 29 shows yet another prior art antenna, wherein two parallel conductors 28 which are disconnected in direct current are inserted in series between the ends of the antenna element 10. The two parallel conductors 18 are inductively coupled together and function as a single antenna element as a whole.

FIG. 30 shows a further prior art antenna, wherein a matching circuit 20 is inserted between one end of the antenna element 10 and the feeding point and the other end of the antenna element 10 is electrically connected to the ground conductor 14. In the prior art antenna shown in FIG. 30, the length of the antenna element 10 is not required to be ½ wavelength of a frequency band in which the antenna operates. The antenna element 10 and the matching circuit 20 should be set appropriately so that the electrical length containing the antenna element 10 and the matching circuit 20 will be ½ wavelength.

However, any antenna of the above prior art is designed to operate in a single frequency band and cannot operate in multiple frequency bands. Thus, a mobile phone that uses two frequency bands needs two antennas for different frequency bands. A mobile communication device in which a plurality of communication systems including GPS are installed needs a plurality of antennas. Hence, it is difficult to reduce the size and weight of a mobile communication device by using any of the above prior art antennas.

It is therefore an object of the present invention, which has been made in view of the above circumstances of prior art, to provide an antenna for multiple bands employing an single antenna element 10, the antenna being capable of operating in multiple frequency bands and ideal for size and weight reduction purposes.

DISCLOSURE OF THE INVENTION

An antenna for multiple bands of the present invention is configured such that one end of an antenna element is electrically connected to a feeding point and the other end thereof is electrically connected to a ground conductor, at least one intermediate point and the other end of the antenna element are electrically connected via switches, respectively, to the ground conductor, the electrical length of the antenna element from the feeding point to the other end plus a connection line from the other end via one switch to the ground conductor and the electrical length of the antenna element from the feeding point to the at least one intermediate point plus a connection line from the at least one intermediate point via another switch to the ground conductor are set to be capable of resonating different desired frequency bands respectively.

By employing a single antenna element and using the switches inserted between the intermediate points and the other end of the antenna element and the ground terminal, a desired number of frequency bands can be set. Thus, this antenna is favorable as a small antenna for mobile communication and operation in multiple frequency bands.

An antenna in which one end of an antenna element is electrically connected to a feeding point and the other end thereof is electrically connected to a ground conductor may be configured such that at least one intermediate point and the other end of the antenna element are electrically connected via series resonant circuits, each comprising a capacitor and a coil, respectively, to the ground conductor, the electrical length of the antenna element from the feeding point to the other end is set to make its resonant frequency equal to a resonant frequency of one series resonant circuit connected to the other end, the electrical length of the antenna element from the feeding point to the at least one intermediate point is set to make its resonant frequency equal to a resonant frequency of another series resonant circuit connected to the at least one intermediate point, and the resonant frequencies of the electrical lengths are set to different desired frequency bands respectively.

An antenna in which one end of an antenna element is electrically connected to a feeding point and the other end thereof is electrically connected to a ground conductor can also be configured such that at least one intermediate point and the other end of the antenna element are electrically connected via filters, respectively, to the ground conductor, one filter connected to the other end allows passage of a resonant frequency with which the electrical length of the antenna element from the feeding point to the other end resonates, another filter connected to the at least one intermediate point allows passage of a resonant frequency with which the electrical length of the antenna element from the feeding point to the at least one intermediate point resonates, each filter blocks passage of a frequency other than the resonant frequency with which the electrical length to the position to which the filter is connected resonates, and the resonant frequencies of the electrical lengths are set to different desired frequency bands respectively.

Furthermore, an antenna in which one end of an antenna element is electrically connected to a feeding point and the other end thereof is electrically connected to a ground conductor can also be configured such that one intermediate point and the other end of the antenna element are electrically connected via parallel resonant circuits, each comprising a capacitor and a coil, respectively, to the ground conductor, the electrical length of the antenna element from the feeding point to the other end is set to make its resonant frequency equal to a resonant frequency of one parallel resonant circuit connected to the one intermediate point, the electrical length of the antenna element from the feeding point to the one intermediate point is set to make its resonant frequency equal to a resonant frequency of another parallel resonant circuit connected to the other end, and the resonant frequencies of the electrical lengths are set to different desired frequency bands respectively.

The antenna for multiple bands thus configured employing the single antenna element is capable of simultaneous antenna operation in multiple frequency bands. Thus, this antenna is favorable for mobile communications in a situation where simultaneous antenna operation in multiple frequency bands is required, for instance, both GPS and mobile phone systems are used.

BRIEF DESCRIPTION OF THE DRAWINGS

FIG. 8 is comprised of FIG. 8A and FIG. 8B, in which

FIG. 11 shows a seventh embodiment of a concrete construction of the fourth embodiment antenna for multiple bands of the present invention shown in FIG. 4, the seventh embodiment having a dielectric and a capacitance coupled antenna element, wherein FIG. 11A is a plan view of the seventh embodiment and FIG. 11B is a front view thereof.

BEST MODE FOR CARRYING OUT THE INVENTION

Figure 1:
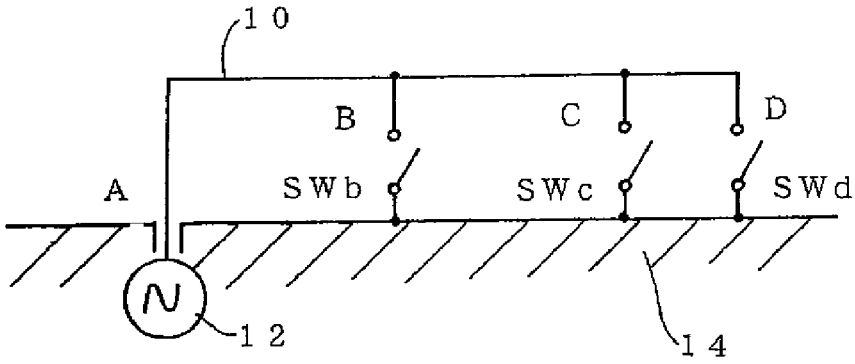
FIG. 1 shows a principle structure of a first embodiment of an antenna for multiple bands of the present invention, using switches.

With reference to FIG. 1, a first embodiment of the present invention will be described below. FIG. 1 shows a principle structure of a first embodiment of an antenna for multiple bands of the present invention, using switches. In FIG. 1, one end of the antenna element 10 is connected to a feeding point 12 and the other end thereof is connected via a switch SWd to a ground conductor 14. Two intermediate points of the antenna element are connected via switches SWb and SWc, respectively, to the ground conductor 14. The most part of the antenna element 10 is straightened in approximately parallel with the ground conductor 14 except the upright sections for the connections to the feeding point 12 and the switches. In the antenna element 10, the electrical length from a point A (one end of the antenna element 10) of the feeding point 12 connection to a point B (one intermediate point on the antenna element 10) of the switch SWb connection is set to ½ wavelength of a first frequency band f1, the electrical length from the point A to a point C (the other intermediate point on the antenna element 10) of the switch SWc connection is set to ½ wavelength of a second frequency band f2, and the electrical length from the point A to a point D (the other end of the antenna element 10) of the switch SWd connection is set to ½ wavelength of a third frequency band f3. It is natural that the center frequencies of the first to third frequency bands f1, f2, and f3 are f3<f2<f1. Of course, the first to third frequencies f1, f2, and f3 are set, respectively, for multiple frequency bands in which the antenna operates.

Figure 26:
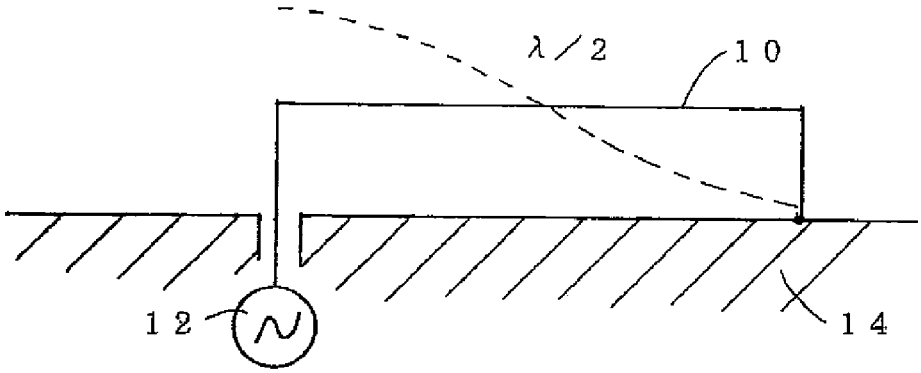
FIG. 26 shows a basic structure of an antenna of prior art.
Figure 27:
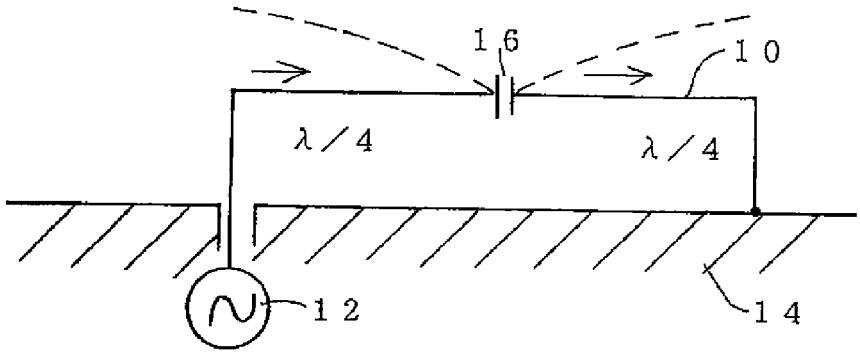
FIG. 27 shows another prior art antenna, wherein a capacitor is inserted in series in the center of the antenna element of the antenna of prior art shown in FIG. 26.
Figure 28:
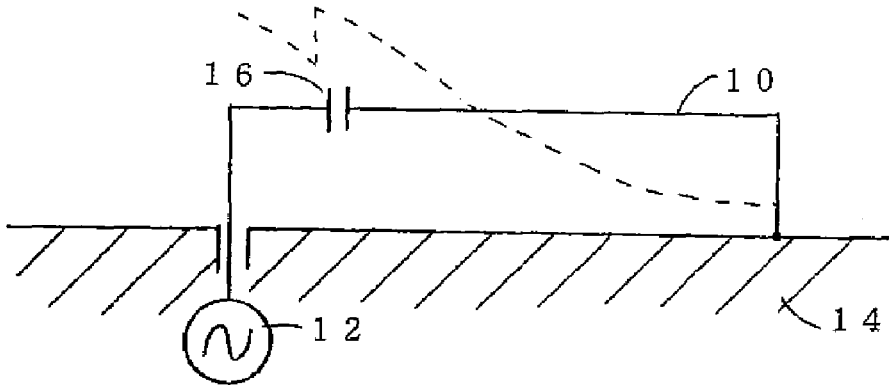
FIG. 28 shows yet another prior art antenna, wherein the capacitor is inserted at a point on the antenna element, nearer to the feeding point 12, of the antenna of prior art shown in FIG. 26.
Figure 29:
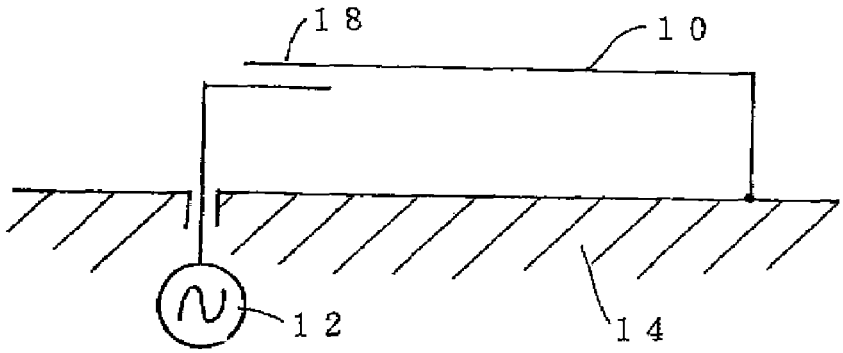
FIG. 29 shows yet another prior art antenna, wherein two parallel conductors which are inductively coupled are inserted in series between the ends of the antenna element, nearer to the feeding point, of the antenna of prior art shown in FIG. 26.
Figure 30:
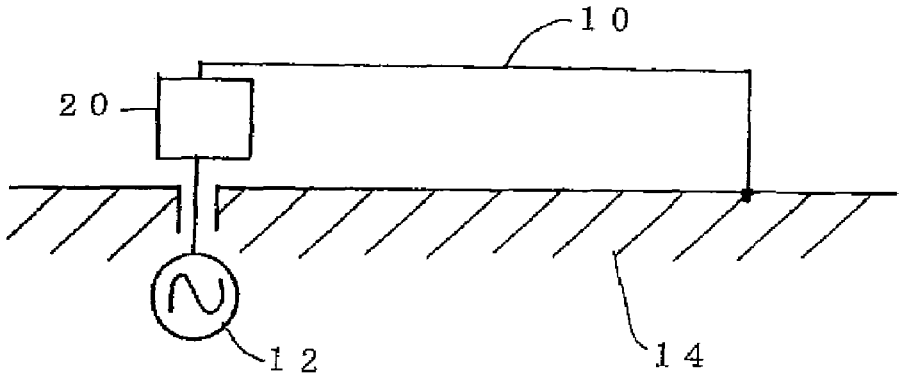
FIG. 30 shows a further prior art antenna, wherein a matching circuit is inserted between one end of the antenna element and the feeding point of the antenna of prior art shown in FIG. 26.

In the first embodiment of the above-described antenna structure, when the switches SWb and SWc are open and only the switch SWd is closed, the antenna with the electrical length from the point A to the point D on the antenna element 10 is formed and functions as the antenna resonating with the third frequency band f3, as is the case for the prior art antenna shown in FIG. 26. Similarly, when the switches SWb and SWd are open and only the switch SWc is closed, the antenna with the electrical length from the point A to the point C on the antenna element 10 is formed and functions as the antenna resonating with the second frequency band f2. When the SWc and SWd are open and only the switch SWb is closed, the antenna functions as the one resonating with the first frequency band f1.

As described above, the first embodiment of the antenna for multiple bands of the present embodiment employs the single antenna element 10, which is preferable for size and weight reduction purposes. By providing as many switches SWb, SWc, and SWd as the required number of frequency bands for which the antenna is designed, the single antenna element 10 can be made adaptive to two or more frequency bands. The switches SWb, SWc, and SWd in the first embodiment are not limited to mechanical ones; of course, they may be semiconductor switches employing pin diodes or the like.

Figure 2:
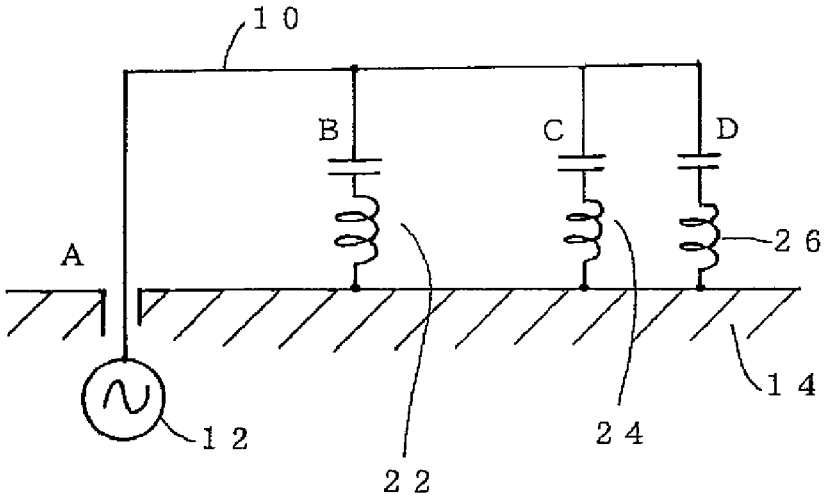
FIG. 2 shows a principle structure of a second embodiment of an antenna for multiple bands of the present invention, using series resonant circuits.

With reference to FIG. 2, a second embodiment of the present invention is now described. FIG. 2 shows a principle structure of a second embodiment of an antenna for multiple bands of the present invention, using series resonant circuits. In FIG. 2, the difference from FIG. 1 lies in that the antenna is provided with first to third series resonant circuits 22, 24, and 26 instead of the switches SWb, SWc, and SWd. The resonant frequency of the first series resonant circuit 22 inserted between the one intermediate point B on the antenna element 10 and the ground conductor 14 is set to the first frequency band f1 with which the electrical length from the feeding point A to the point B resonates. Similarly, the resonant frequency of the second series resonant circuit 24 inserted between the other intermediate point C on the antenna element 10 and the ground conductor 14 is set to the second frequency band f2 with which the electrical length from the feeding point A to the point C resonates. The resonant frequency of the third series resonant circuit 26 inserted between the other end D of the antenna element 10 and the ground conductor 14 is set to the third frequency band f3 with which the electrical length from the feeding point A to the other end D resonates.

In the second embodiment of the above-described antenna structure, at the first frequency band f1, the antenna operates with the same action as the one intermediate point C was electrically short-circuited via the first series resonant circuit 22 to the ground conductor 14 and functions as the one resonating with the first frequency band f1. Similarly, at the second frequency band f2, the other intermediate point D is short-circuited via the second series resonant circuit 24 and grounded and the antenna functions as the one resonating with the second frequency band f2. At the third frequency band f3, the other end D is short-circuited via the second series resonant circuit 24 and grounded and the antenna functions as the one resonating with the second frequency band f3. Thus, the antenna of the second embodiment is enabled to operate in the first to third frequency bands f1, f2, and f3 at the same time and a circuit or equivalent for frequency separation should be provided appropriately near the feeding point 12. Hence, the antenna for multiple bands of the second embodiment employing the single antenna element 10 is preferable as an antenna for mobile communications in an situation where simultaneous antenna operation in multiple bands is required, for instance, both GPS and mobile phone systems are used. In the above description, the series resonant circuits 22, 24, 26 are designed to behave such that those other than one that is electrically short-circuited to resonate with a frequency band are electrically disconnected. It will be appreciated that the electrical lengths of the antenna element 10 from the feeding point A to the intermediate points B, C, and the other end D may be set appropriately in consideration of the electrical effect of a series resonant circuit, when grounded, on the remaining non-grounded ones for other frequency bands.

Figure 3:
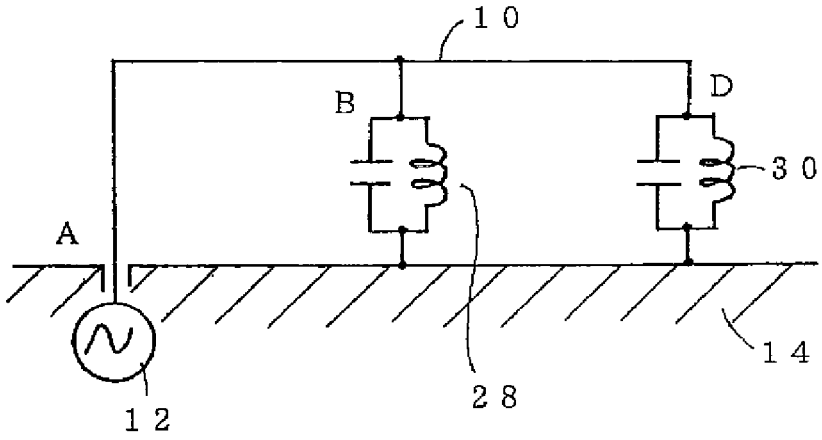
FIG. 3 shows a principle structure of a third embodiment of an antenna for multiple bands of the present invention, using parallel resonant circuits.

With reference to FIG. 3, a third embodiment of the present invention is not described. FIG. 3 shows a principle structure of a third embodiment of an antenna for multiple bands of the present invention, using parallel resonant circuits. In FIG. 3, the difference from FIG. 2 lies in that only a single intermediate point B is present on the antenna element 10, a first parallel resonant circuit 28 is inserted between the intermediate point B and the ground conductor 14, and a second parallel resonant circuit 30 is inserted between the other end D and the ground conductor 14. The resonant frequency of the first parallel resonant circuit 28 is set to the third frequency band f3 with which the electrical length from the feeding point A to the other end D resonates and the first parallel resonant circuit 28 behaves as a trap circuit of the third frequency band f3. The intermediate point B is electrically short-circuited to the ground conductor 14 at the first frequency band f1 with which the electrical length from the point A to the point B resonates and electrically disconnected from the ground conductor 14 at the third frequency band f3. This makes the antenna function as the one resonating with the first frequency band f1. Similarly, the other end D is electrically disconnected from the ground conductor 14 at the first frequency band f1 and electrically short-circuited to the ground conductor 14 at the third frequency band. This makes the antenna function as the one resonating with the third frequency band f3. In the above description, the parallel resonant circuits 28 and 30 are designed to behave such that one not involved in a trap of a frequency band does no electrical action. It will be appreciated that the electrical lengths of the antenna element 10 from the feeding point A to the intermediate point B and the other end D may be set appropriately in consideration of the electrical effect of one of the parallel resonant circuits 28 when it performs a frequency trap on the other for a frequency band not trapped. Thus, the antenna for multiple bands of the third embodiment employing the single antenna element 10 is capable of simultaneous antenna operation in multiple bands in a similar manner as the second embodiment and is preferable as an antenna for mobile communications in an situation where simultaneous antenna operation in multiple bands is required, for instance, both GPS and mobile phone systems are used.

In the second and third embodiments, the series and parallel resonant circuits may be configured as either lumped parameter circuits or distributed parameter circuits.

Figure 4:
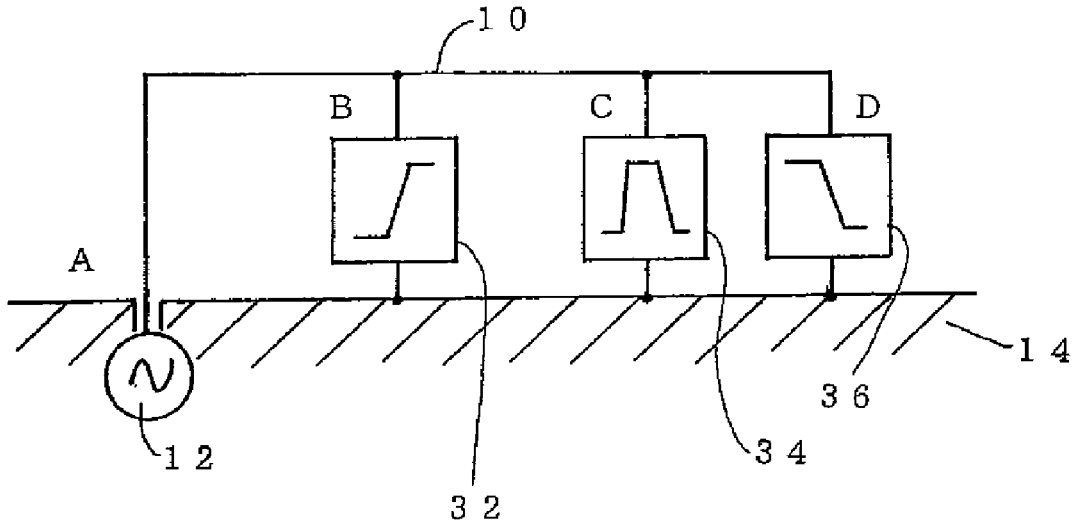
FIG. 4 shows a principle structure of a fourth embodiment of an antenna for multiple bands of the present invention, using filters.

With reference to FIG. 4, a fourth embodiment of the present invention is now described. FIG. 4 shows a principle structure of a fourth embodiment of an antenna for multiple bands of the present invention, using filters. In FIG. 4, the difference from FIG. 1 lies in that the antenna is provided with a high-pass filter 32, a bandpass filter 34, and low-pass filter 36 instead of the switches SWb, SWc, and SWd. The high-pass filter 32 inserted between the one intermediate point B on the antenna element 10 and the ground conductor 14 is set to allow the passage of the first frequency band f1 with which the electrical length from the feeding point A to the point B resonates and block the passage of other second and third frequency bands f2 and f3. The bandpass filter 34 inserted between the other intermediate point C and the ground conductor 14 is set to allow the passage of the second frequency band f2 with which the electrical length from the feeding point A to the point C resonates and block the passage of other first and third frequency bands f1 and f3. Similarly, the low-pass filter 36 inserted between the other end D and the ground conductor 14 is set to allow the passage of the third frequency band f3 with which the electrical length from the feeding point A to the other end D resonates and block the passage of other first and second frequency bands f1 and f2.

In the fourth embodiment of the above-described antenna structure, the filters 32, 34, and 36 behave to make the ground connection of one of the intermediate points B, C, and the other end D at the frequency band with which the electrical length from the feeding point A to that point resonates and disconnect the ground connection at other frequency bands. Thus, the fourth embodiment antenna is capable of simultaneous antenna operation in the first to third frequency bands f1, f2, and f3 in a similar manner as the second embodiment. Hence, the antenna for multiple bands of the fourth embodiment employing the single antenna element 10 is preferable as an antenna for mobile communications in an situation where simultaneous antenna operation in multiple bands is required, for instance, both GPS and mobile phone systems are used, as is the case for the second and third embodiments. It will be appreciated that the high-pass filter 32 and the low-pass filter 36 may be bandpass filters allowing the passage of the first frequency band f1 and the third frequency band f3, respectively.

Figure 5:
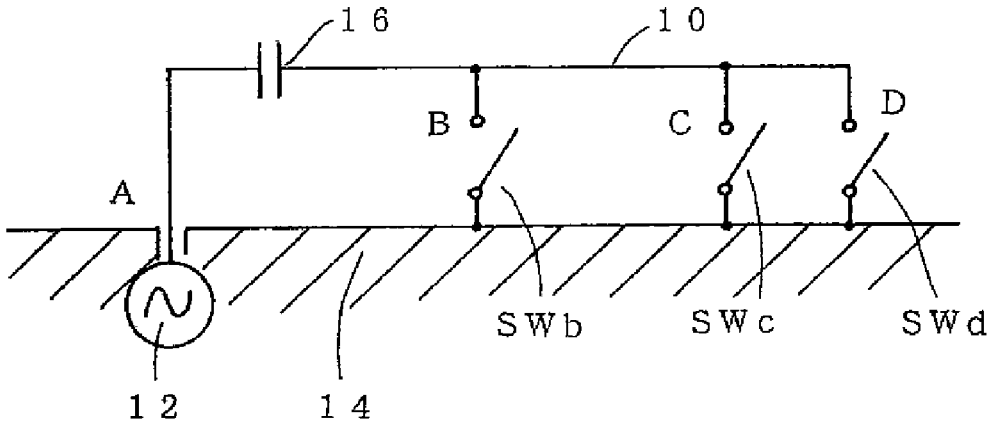
FIG. 5 shows an antenna structure modification to the first embodiment, wherein a capacitor is inserted in series between the feeding point and one intermediate point nearer to the feeding point on the antenna element.
Figure 6:
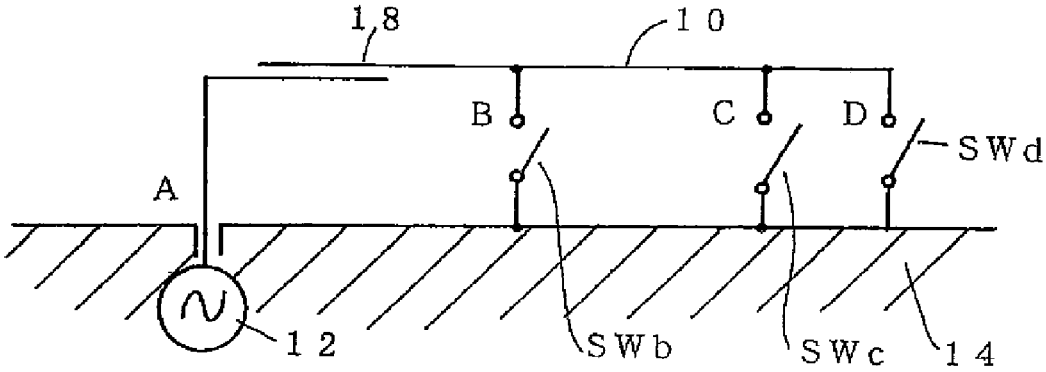
FIG. 6 shows another antenna structure modification to the first embodiment, wherein inductively coupled parallel conductors are inserted in series between the feeding point and one intermediate point nearer to the feeding point on the antenna element.
Figure 7:
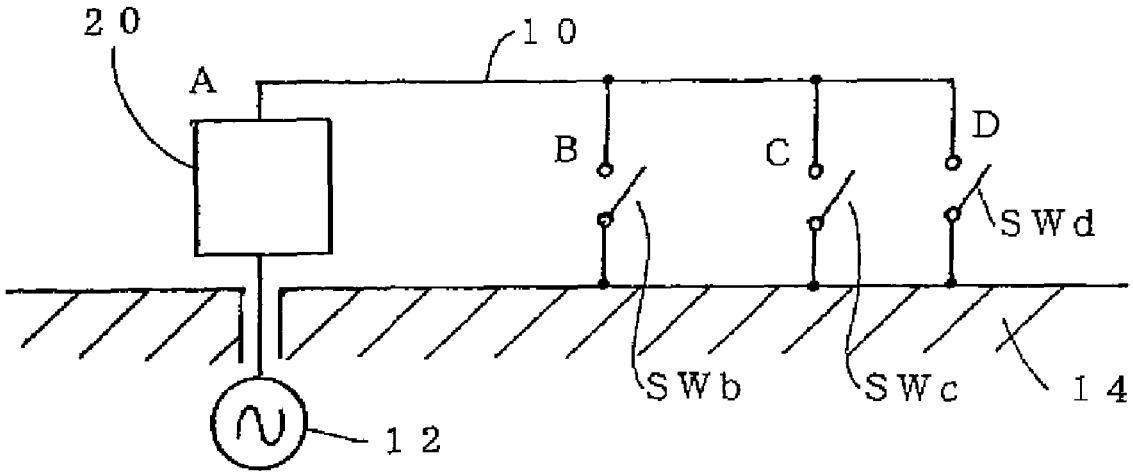
FIG. 7 shows yet another antenna structure modification to the first embodiment, wherein a matching circuit is inserted between one end of the antenna element and the feeding point.

The first embodiment antenna shown in FIG. 1 maybe modified such that a capacitor 16 is inserted in series between the feeding point 12 and one intermediate point nearer to the feeding point on the antenna element 10, as is shown in FIG. 5. A capacitance coupled circuit may be used instead of the capacitor 16. The first embodiment antenna shown in FIG. 1 may be modified such that two parallel conductors 18 which are inductively coupled together are inserted in series between the feeding point 12 and one intermediate point nearer to the feeding point on the antenna element 10, as is shown in FIG. 6. Furthermore, the first embodiment antenna shown in FIG. 1 may be modified such that a matching circuit 20 is inserted between one end A of the antenna element 10 and the feeding point 12, as is shown in FIG. 7. In the first embodiment modifications shown in FIGS. 5 through 7, the electrical lengths should be set in consideration of the capacitor 16, parallel conductors 18, and matching circuit 20 inserted. Furthermore, the antenna structures of the second through fourth embodiments may be modified, like the first embodiment modifications shown in FIGS. 5 through 7. Thereby, the electrical lengths of the single antenna element 10 enabling the antenna to operate in multiple bands can be designed appropriately by provision of the capacitor C or the matching circuit 20.

Figure 8A:
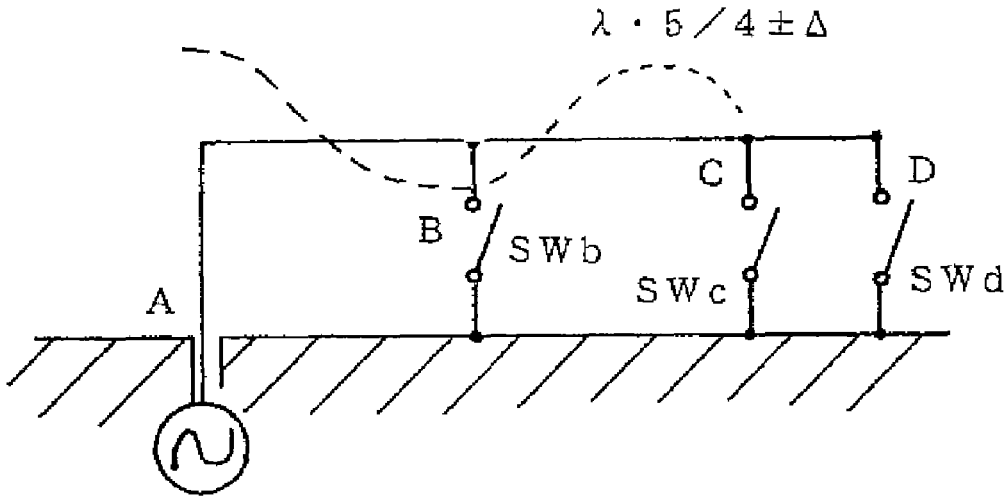
FIG. 8A depicts a case where, in the structure of the first embodiment antenna shown in FIG. 1, the electrical length of the antenna element to a point of connection of an open switch resonates with a frequency in the vicinity of a frequency band with which the electrical length of the antenna element to a point of connection of a closed switch resonates.
Figure 8B:
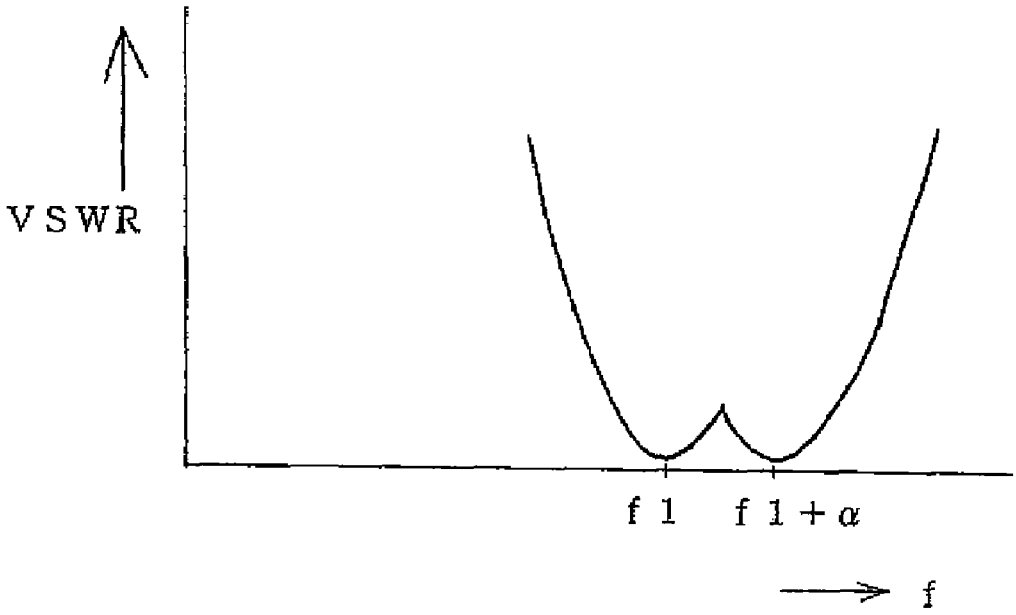
FIG. 8B is a graph to depict an antiresonance point produced by the two resonant frequencies which are close to each other.

By the way, in the first embodiment antenna shown in FIG. 1, assume that the switch SWb is closed, while the switches SWc and SWd are open, in the antenna structure shown in FIG. 8A, and the electrical length of the antenna element 10 from the feeding point A to the point B resonates with the first frequency band f1. At this time, if the electrical length of the antenna element 10 from the feeding point A to the point C and/or the electrical length from the feeding point A to the other end D with regard to the wavelength (λ) of the first frequency f1 are contingently $\lambda\cdot(1/4+n\cdot 1/2)\pm\Delta$ (where n is an integer), such as, for example, $\lambda 5/4\pm\Delta$, as indicated by a dotted line, that length will also resonate with a frequency f1±α in the vicinity of the first frequency f1. In consequence, there is a possibility that an antiresonance point is produced by the first frequency band f1 and the frequency f1±α in the vicinity of the first frequency, as is shown in FIG. 8B. This antiresonance point deteriorates a VSWR characteristic and results in a decrease in the antenna gain. In view hereof, it is desirable that an antiresonance point does not exist within a frequency bandwidth to be used.

Figure 9:
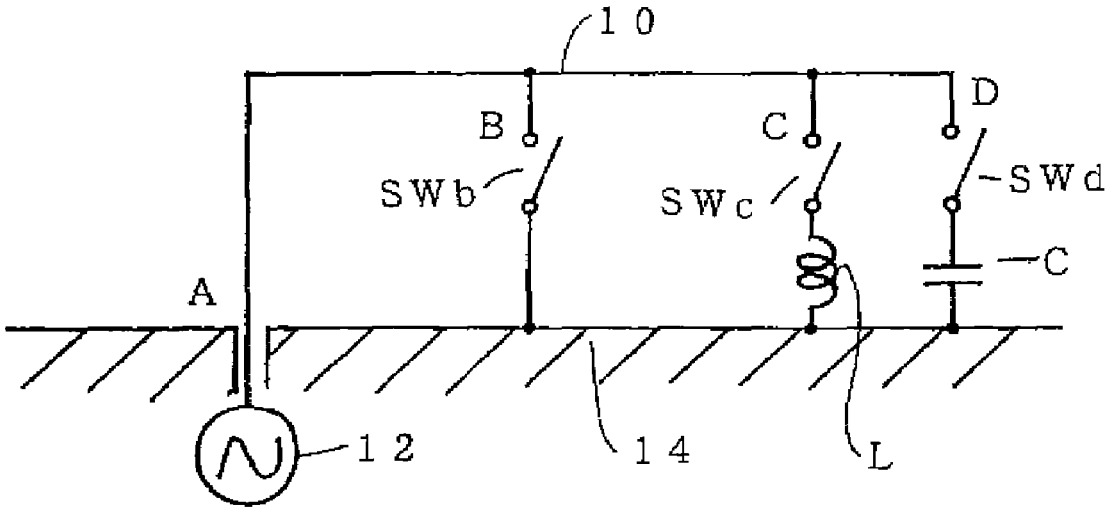
FIG. 9 shows an antenna structure of a fifth embodiment devised to solve the problem described with the antenna structure shown in FIG. 8.

A fifth embodiment of an antenna structure which is shown in FIG. 9 is an example of means for solving this problem. In the fifth embodiment, one end of the switch SWb is connected to the one intermediate point B on the antenna element 10 and the other end of the swith SWb is connected to the ground connector 14 directly. One end of the switch SWc is connected to the other intermediate point C on the antenna element 10 and the other end of the switch SWc is connected via an extension coil L inserted in series to the ground conductor 14. One end of the switch SWd is connected to the other end D and the other end of the switch SWd is connected via a short capacitor C inserted in series to the ground conductor 14. By inserting the extension coil L appropriately, it is possible to shorten the electrical length of the antenna element 10 from the feeding point A to the other intermediate point C. By inserting the short capacitor C appropriately, it is possible to elongate the electrical length from the feeding point A to the other end D on the antenna element 10. Thereby, it can be avoided during the first frequency band H operation that the electrical lengths from the feeding point to the point C and the other end D resonate with a frequency in the vicinity of the first frequency band f1, resulting in an antiresonance point within the frequency bandwidth in use. Here, needless to say, with the switch SWc closed, the electrical length of the antenna element 10 from the feeding point A to the intermediate point C modified by the extension coil L is set to ½ wavelength of the second frequency band f2. With the switch SWd closed, the electrical length of the antenna element 10 from the feeding point 10 to the other end point D modified by the short capacitor C is set to ½ wavelength of the third frequency band f3.

While the possibility that, when the electrical length from the feeding point to the one intermediate point B resonates with the first frequency f1, the electrical lengths from the feeding point to the intermediate point C and the other end D resonate with a frequency in the vicinity of the first frequency has been illustrated in the antenna structure shown in FIG. 8, there is also a possibility that, when the electrical length from the feeding point to the other intermediate point C resonates with the second frequency band 12, the electrical length from the feeding point to the other end D resonates with a frequency in the vicinity of the second frequency. In such cases, it will easily be appreciated that the intermediate points B, C, and the other end D should be connected, respectively, to one ends of the switches SWb, SWc, and SWd, and in the other ends of others of these switches SWb, SWc and Swd should be connected to the ground conductor 14 directly, and the others of these switches SWb, SWc, and SWd should be connected, respectively, to the ground conductor 14 appropriately with an extension coil or a short capacitor inserted in series therebetween, to prevent an antiresonance point from being within any frequency bandwidth in use.

Figure 10:
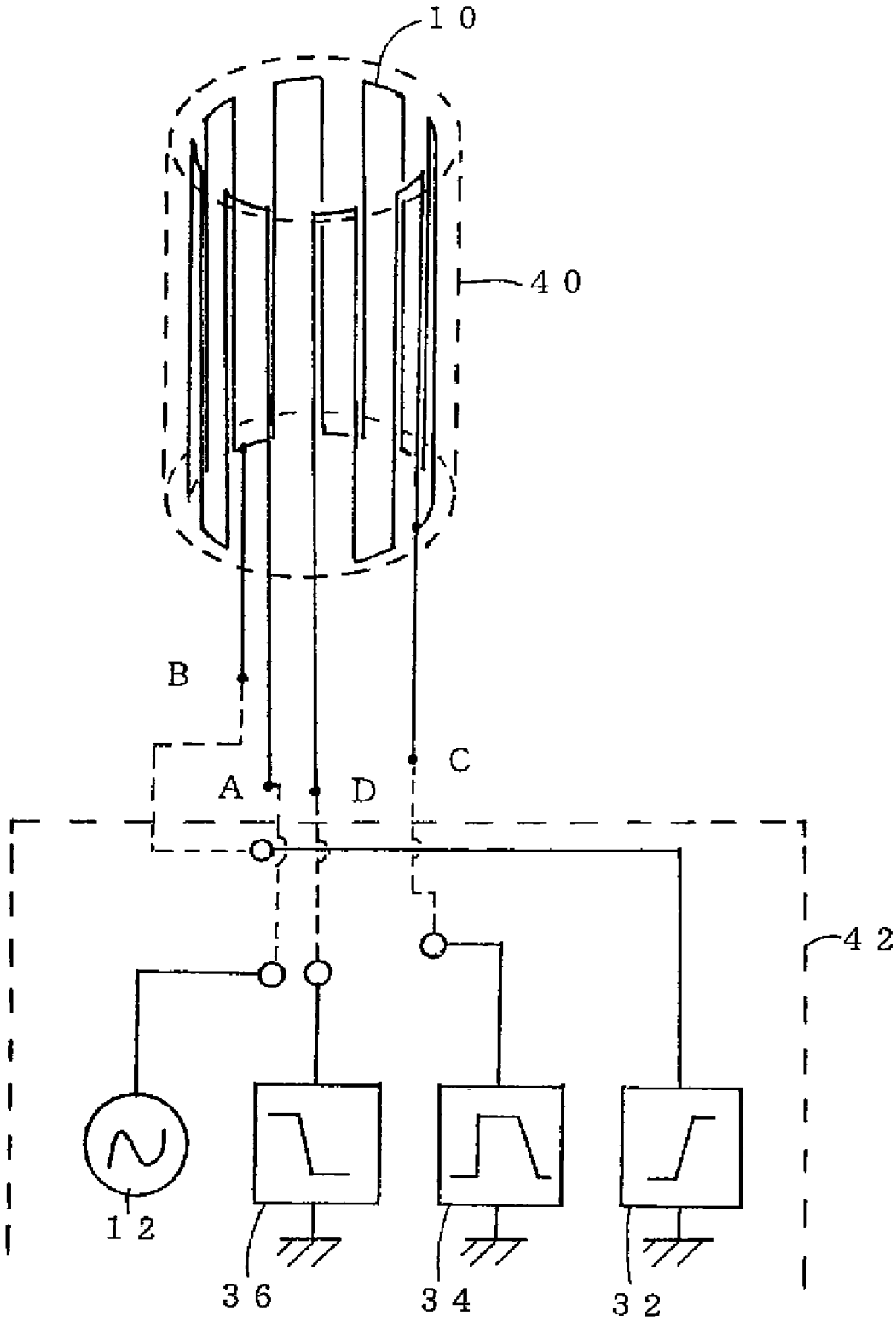
FIG. 10 shows a sixth embodiment of a concrete construction of the fourth embodiment antenna for multiple bands of the present invention shown in FIG. 4.

Next, concrete configuration examples of the antenna for multiple bands of the present invention will be described. FIG. 10 shows a sixth embodiment of a concrete construction of the fourth embodiment antenna for multiple bands of the present invention shown in FIG. 4. In FIG. 10, the antenna element 10 is formed along an imaginary circular cylinder plane in a meandering pattern turned around repeatedly between both ends of the cylinder, parallel to the center axis of the cylinder, for size reduction purposes. The antenna element is sheathed in a cover 40 made of suitable insulating resin. One end A, the intermediate points C, D, and the other end D of the antenna element 10 are appropriately drawn out and electrically connected to connection terminals not shown. On the other hand, the feeding point 12, the high-pass filter 32, bandpass filter 34, and the low-pass filter 36 are provided on a substrate 42 and electrically connected to connection terminals appropriately. On the substrate 42, a ground conductor not shown is provided and the filters 32, 34, and 36 are grounded to it. The substrate 42 is housed in a casing not shown. In the casing, the antenna element 10 is installed in a position so as to protrude outside and to be removable and the one end A, the intermediate points B, C, and the other end D of the antenna element 10 are positioned so that they can be connected to and disconnected from the feeding point and the filters 32, 34, and 36, respectively. Of course, the antenna element 10 shown in FIG. 10 can be applied to the first to third embodiments shown in FIGS. 1 through 3, respectively. By forming the antenna element 10 in a meandering pattern, the outside dimension of the whole antenna element 10 can be reduced. Because the antenna element 10 is formed in the meandering pattern which is formed along the imaginary circular cylindrical plane and its external connections can be connected to and disconnected from its associated component circuits, only the antenna element 10 can be installed later in the antenna manufacturing process. If the antenna fails, it can be replaced with ease. This antenna embodiment is preferable as an antenna that is installed protruding outside the mobile phone casing.

Figure 11:
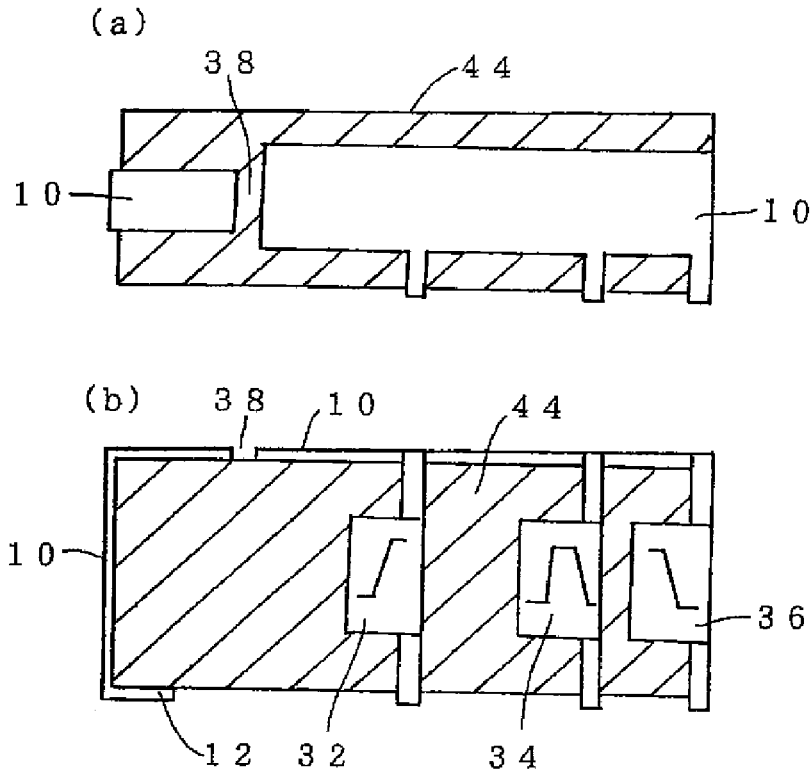

FIG. 11 shows a seventh embodiment of a concrete construction of the fourth embodiment antenna for multiple bands of the present invention shown in FIG. 4, the seventh embodiment having a dielectric and a capacitance coupled antenna element, wherein FIG. 11A is a plan view of the seventh embodiment and FIG. 11B is a front view thereof. In FIG. 11, the antenna element 10, the feeding point A, and the filters 32, 34, and 36*a* are arranged on the surfaces of the dielectric 44. The antenna element 10 is configured to be separated into two parts by a gap in an intermediate position nearer to the feeding point, so that the ends of the two parts facing each other across the gap are capacitance coupled 38 together. The antenna element can be formed in a thin metal film on the surfaces of the dielectric 44 by plating, vapor deposition, and the like, which is preferable for mass production. Because the dielectric 44 has an effect of decreasing wavelength, the physical length of the antenna element 10 can be shortened and, accordingly, this embodiment is preferable for size reduction. Although the antenna element 10 is formed on the surfaces of the dielectric 44, the dielectric 44 may be layered and the filters 32, 34, and 36 may be placed between layers in the dielectric 44. The filters 32, 34, and 36 may be placed in any position in the dielectric 44.

Figure 12:
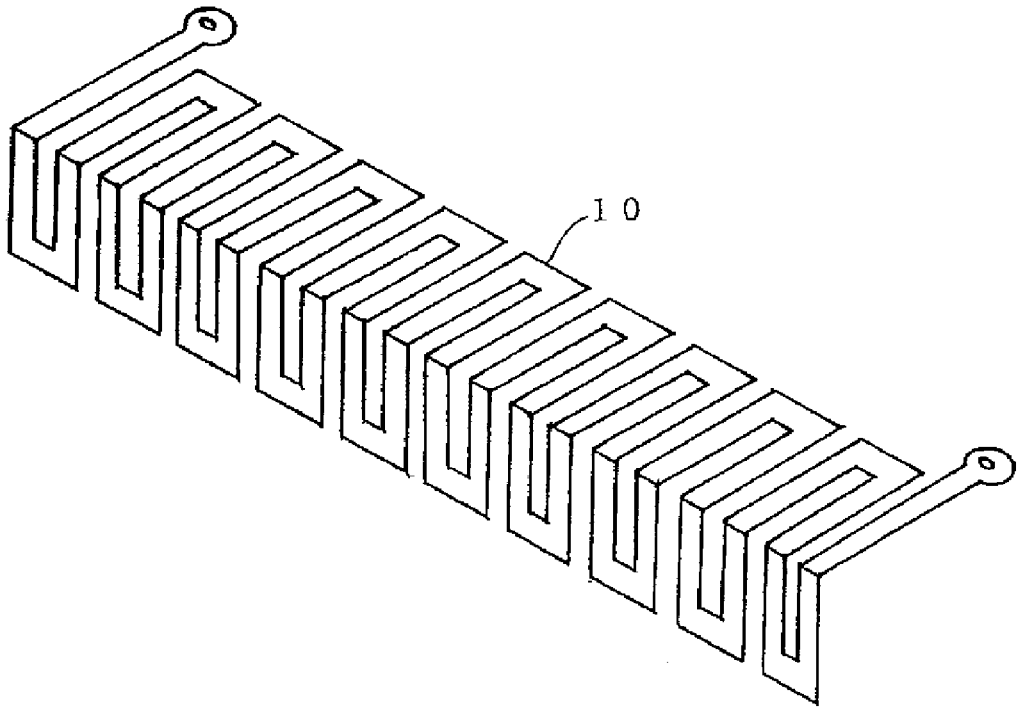
FIG. 12 shows a meandering pattern of the antenna element bent widthwise at a right angle, so that an "L" shape section is viewed from its end side.
Figure 13:
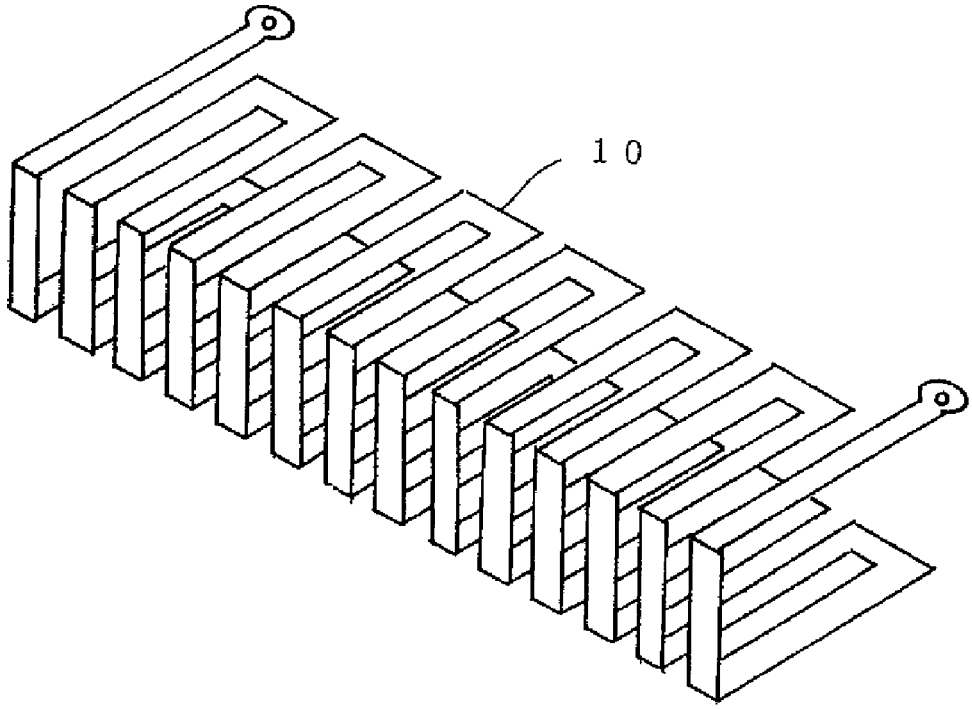
FIG. 13 shows the meandering pattern of the antenna element bent widthwise at a right angle twice, so that an angular "U" shape section is viewed from its end side.
Figure 14:
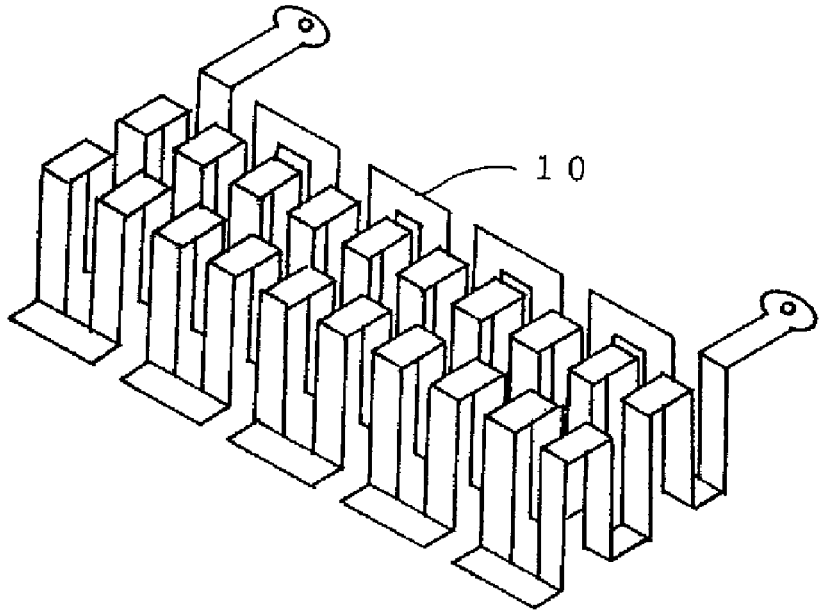
FIG. 14 shows the meandering pattern of the antenna element bent widthwise at a right angle repeatedly, so that a meandering shape section is viewed from its end side as well.

To further reduce the dimensions of the antenna element 10, a meandering pattern of the antenna element on the flat may be bent widthwise at a right angle, so that an "L" shape section is viewed from its end side, as an example which is shown in FIG. 12. As another example which is shown in FIG. 13, the meandering pattern of the antenna element may be bent widthwise at a right angle twice, so that an angular "U" shape section is viewed from its end side. As yet another example which is shown in FIG. 14, the meandering pattern of the antenna element may be bent widthwise at a right angle repeatedly, so that a meandering shape section is viewed from its end side as well.

Moreover, an eighth embodiment of the present invention will be described with reference to FIGS. 15 through 20

Figure 15:
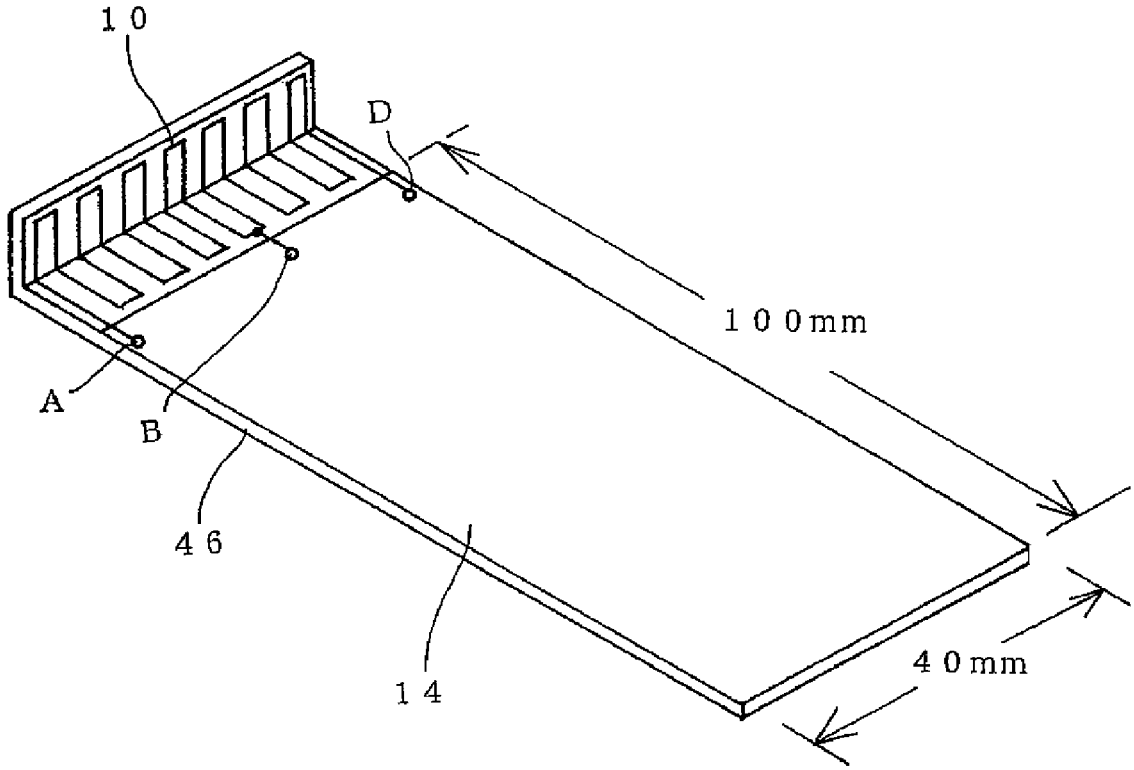
FIG. 15 is an outside perspective view of a concrete example of an antenna for multiple bands of the present invention on the assumption that the antenna is used in a mobile phone.
Figure 16:
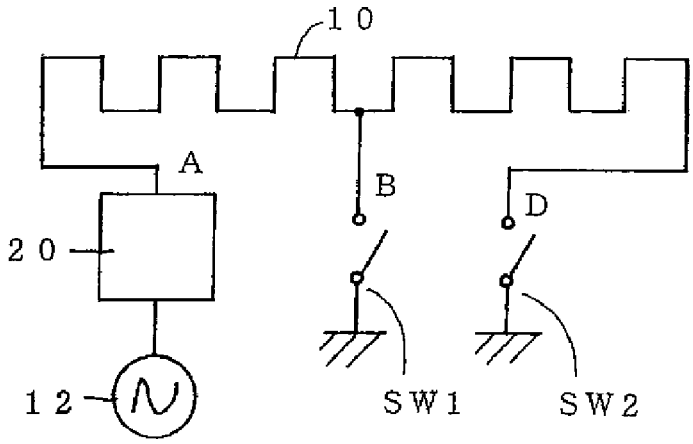
FIG. 16 is a structural diagram of the antenna for multiple bands shown in FIG. 15.
Figure 17:
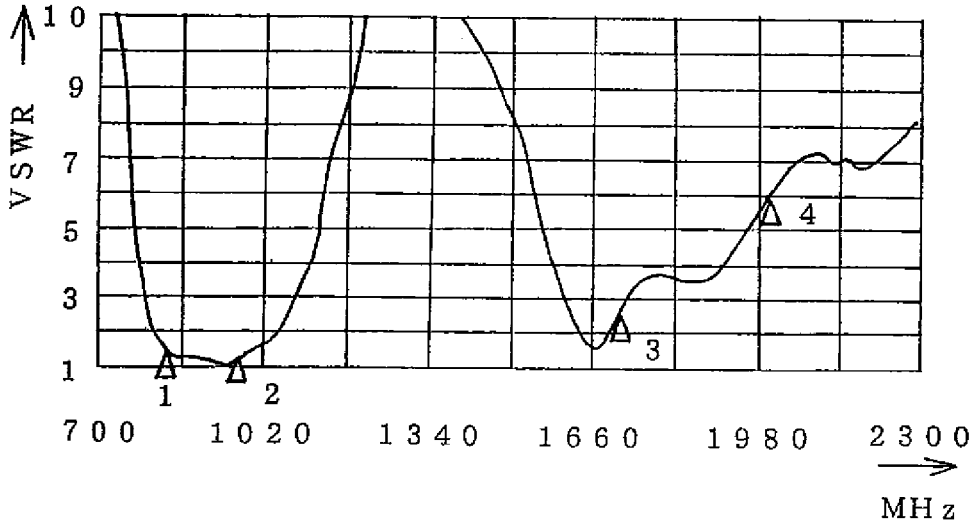
FIG. 17 shows a VSWR characteristic graph when SW1 is open and SW2 is closed in the antenna for multiple bands shown in FIG. 16.
Figure 18:
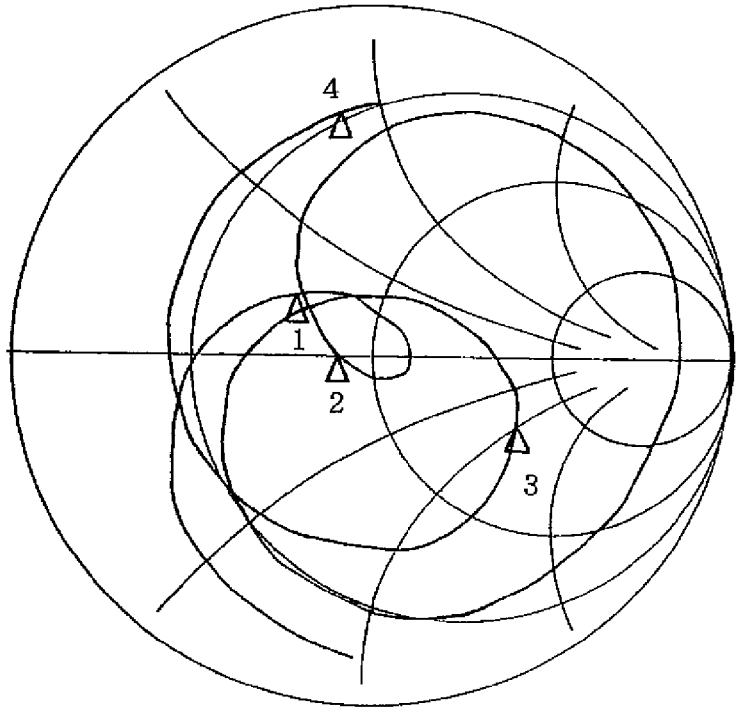
FIG. 18 shows a Smith chart when SW1 is open and SW2 is closed in the antenna for multiple bands shown in FIG. 16.
Figure 19:
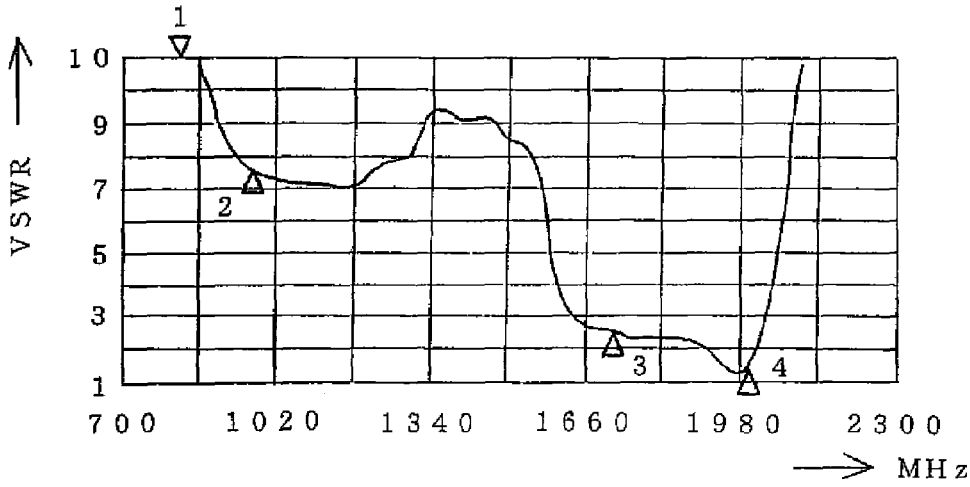
FIG. 19 shows a VSWR characteristic graph when SW1 is closed and SW2 is open in the antenna for multiple bands shown in FIG. 16.
Figure 20:
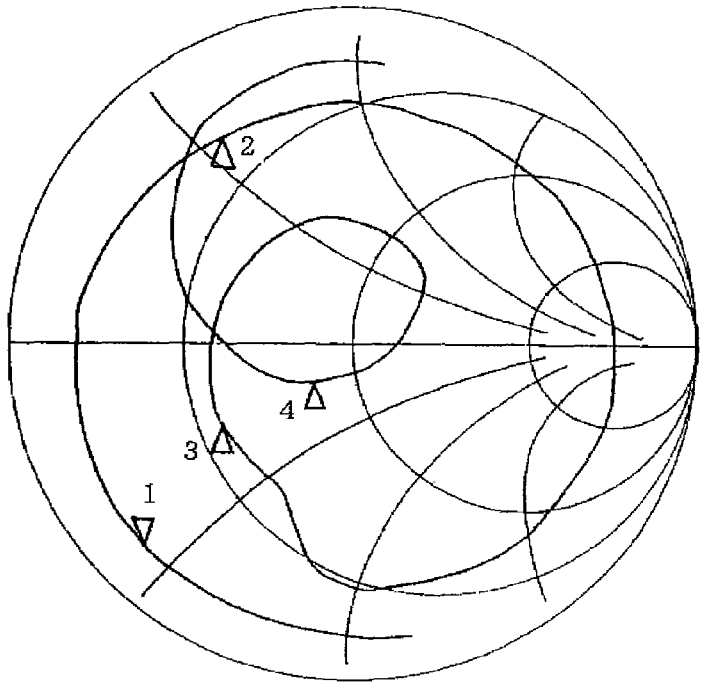
FIG. 20 shows a Smith chart when SW1 is closed and SW2 is open in the antenna for multiple bands shown in FIG. 16.

FIG. 15 is an outside perspective view of a concrete example of an antenna for multiple bands of the present invention on the assumption that the antenna is used in a mobile phone. FIG. 16 is a structural diagram of the antenna for multiple bands shown in FIG. 15. FIG. 17 shows a VSWR (voltage standing wave ratio) characteristic graph when SW1 is open and SW2 is closed in the antenna for multiple bands shown in FIG. 16. FIG. 18 shows a Smith chart when SW1 is open and SW2 is closed in the antenna for multiple bands shown in FIG. 16. FIG. 19 shows a VSWR characteristic graph when SW1 is closed and SW2 is open in the antenna for multiple bands shown in FIG. 16. FIG. 20 shows a Smith chart when SW1 is closed and SW2 is open in the antenna for multiple bands shown in FIG. 16.

In FIG. 15, the ground conductor 14 is a rectangle with a short side of 40 mm and a long side of 100 mm and the antenna element 10 is formed, bordering on one short side of the ground conductor, separated from the ground conductor 14. This antenna element 10 is formed in an meandering pattern turned around repeatedly in a direction parallel to the long sides of the rectangular ground conductor 14 and the meandering pattern is bent widthwise at a right angle so that a substantially "L" shape section is viewed from its end side. One end A, an intermediate point B, and the other end D of the antenna element 10 are connected appropriately to associated circuits mounted on a substrate 4 on which the ground conductor 14 is provided, without being electrically connected to the ground conductor 14. As shown in FIG. 16, the one end A is connected via a matching circuit 20 to the feeding point 12, the intermediate point B is connected via a first switch SW1 to the ground conductor 14, and the other end D is grounded via a second switch SW2. The antenna embodiment shown in FIGS. 15 and 16 is configured to be capable of operating in two frequency bands for mobile phone use, an 800 MHz band and a 1800 MHz band.

When the first switch SW1 is open and the second switch SW2 is closed, the antenna element resonates with a low frequency band and a good VSWR characteristic of less than 2 is measured in a range of 824-960 MHz according to FIG. 17. Also, impedance near to approximately 50Ω is obtained in the range of 824-960 MHz, as indicated in FIG. 18. Thus, this antenna embodiment can be used as an antenna operating over a wide frequency band covering both an 824-894 MHz GSM band to be applied in U.S. and an 880-960 MHz GSM band applied in Europe. When the first switch SW1 is closed and the second switch SW2 is open, the antenna element resonates with a high frequency band and a good VSWR characteristic of less than 2.6 is measured in a range of 1710-1990 MHz according to FIG. 19. Also, impedance near to approximately 50 Ω is obtained in the range of 1710-1990 MHz, as indicated in FIG. 20. Thus, this antenna embodiment can be used as an antenna operating over a wide frequency band covering both an 1850-1990 MHz GSM band to be applied in U.S. and a 1710-1880 MHz GSM band applied in Europe. Because the antenna element 10 is formed, bordering on the one short side of the rectangular ground conductor 14, this antenna embodiment is preferable for a mobile phone construction with folding halves (shells) in which the ground conductor 1 is provided in an operation side shell with operation buttons arranged thereon and the antenna element 10 is installed near the folding hinges. This antenna embodiment is also preferable for a mobile phone construction in which the antenna element 10 is installed on the end (the moving end opposite to the end with the hinges) of either the operation side shell or a display side shell having a display screen.

The above antenna embodiments shown in the FIGS. 1, 2, and 4 through 11 are designed to be capable of operating in three frequency bands and the antenna embodiments shown FIGS. 3, 15, and 26 are designed to be capable of operating in two frequency bands; however, the number of frequency bands may be set appropriately so that the antenna can cover the required number of frequency bands for which the antenna is designed. Size reduction of the antenna for multiple bands of the present invention by forming the antenna element 10 in a meandering pattern or by other ways and the dimensions and shape of the ground conductor 14 have an influence on the antenna characteristics. If, for example, the dimensions of the ground conductor 14 shown in FIG. 15 are modified to a rectangle with a short side of 40 mm and a long side of 80 mm, the gain, directivity, and the like may change, but the antenna can be put in practical use sufficiently. The way to reduce the size of the antenna element 10 is not limited to forming the antenna element in a meandering pattern; the antenna element may be formed in a saw tooth wave, wave, or spiral pattern. Moreover, for the switches SWb, SWc, and SWd and the switches SW1 and SW2, a changeover switch with a common contact that is electrically connected to the ground conductor 14 may be used.

Figure 21:
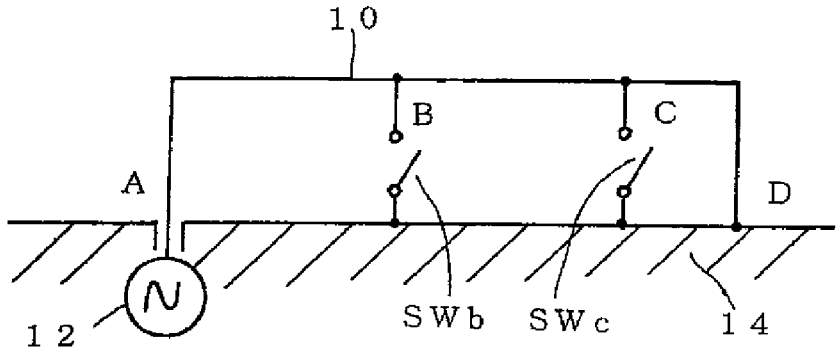
FIG. 21 shows an antenna structure modification to the first embodiment, wherein the other end of the antenna element is electrically connected directly to the ground conductor without intervention of the switch SWd.

Furthermore, the first embodiment antenna of FIG. 1 may be modified such that the other end D of the antenna element 10 is electrically connected directly to the ground conductor 14 without intervention of the switch SWd, as is shown in FIG. 21. Similarly, the second embodiment antenna of FIG. 2 and the fourth embodiment antenna of FIG. 4 may be modified such that the other end D of the antenna element 10 is electrically connected directly to the ground conductor 14 without intervention of the third series resonant circuit 26 or the low-pass filter 36. In the thus modified antenna structure, because the other end D of the antenna element 10 is electrically connected directly to the ground conductor 14, the construction becomes simpler accordingly.

Figure 22:
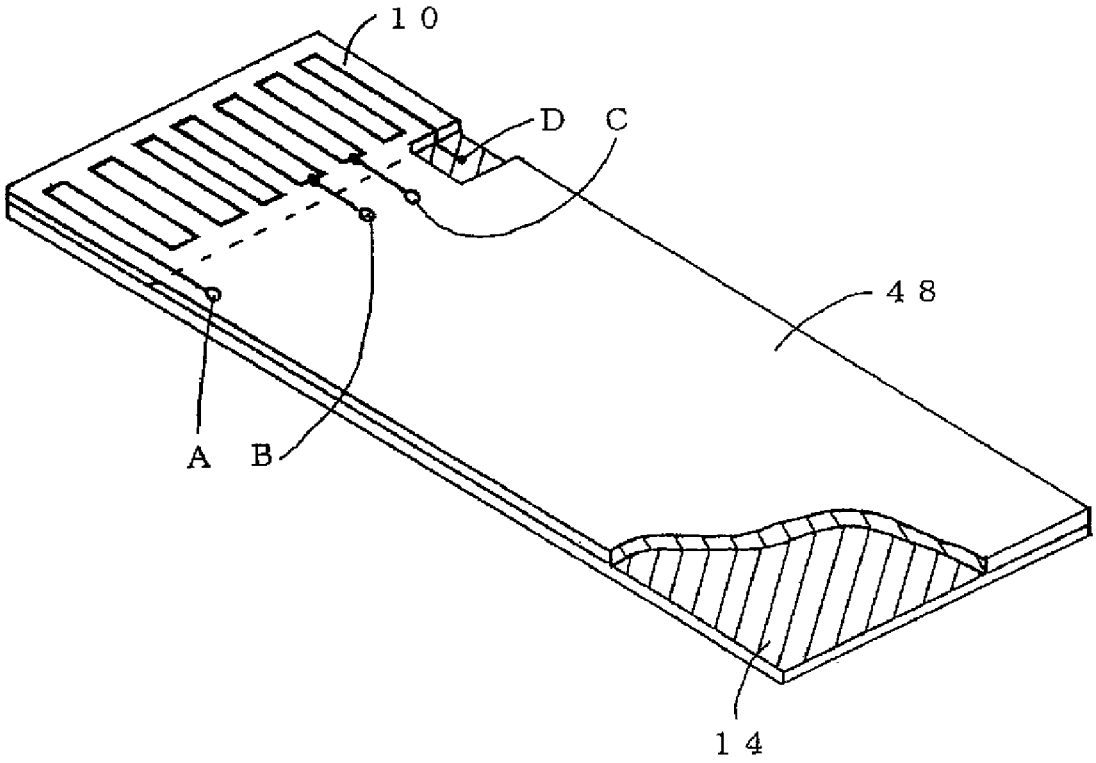
FIG. 22 is an outside perspective view of a concrete example of the antenna for multiple bands of the present invention in which the other end of the antenna element is electrically connected directly to the ground conductor, shown in FIG. 21, on the assumption that the antenna is used in a mobile phone.

FIG. 22 is an outside perspective view of a concrete example of the antenna for multiple bands of the present invention in which the other end D of the antenna element 10 is electrically connected directly to the ground conductor 14, shown in FIG. 21, on the assumption that the antenna is used in a mobile phone. In the example shown in FIG. 22, a substrate 48 consists of two layers of flat circuit boards, in which a rectangular ground conductor 14 is provided on the lower layer and circuits or equivalent are arranged appropriately on the upper layer. In one end of the upper layer of the substrate 48, corresponding to one short side of the ground conductor 14, the antenna element 10 formed in an meandering pattern turned around repeatedly in a direction parallel to the long sides of the rectangular ground conductor 14 is provided. The ground conductor 14 is not provided in a portion of the lower layer just under the antenna element 10, and the antenna element 10 is provided, separated from the ground conductor 14. One end A terminated at a feeding point and intermediate points B and C of the antenna element 10 are electrically connected appropriately to associated circuits or equivalent arranged on the upper layer and the other end D is electrically connected to the ground conductor 14 on the lower layer. The electrical connection of the other end D to the ground conductor 14 may be made by a notch made in a part of the upper layer of the substrate 48 or a through hole formed through the upper layer. Because the antenna element 10 is provided on the flat substrate 48, it is easy to form the antenna element 10.

By employing the antenna element formed in the meandering pattern turned around repeatedly in a direction parallel to the long sides of the ground conductor 14, the antenna size can be reduced. The substrate 48 is not limited to the one consisting of two layers of circuit boards; it may consist of three or more layers or may be a substrate with its front side having circuits or equivalent arranged thereon and its reverse side having the ground conductor 14 provided thereon. The antenna element 10 formed in the meandering pattern turned around repeatedly in a direction parallel to the long sides of the ground conductor 14 shown in FIG. 22 was found to have a high gain at a relatively high frequency band of 1800 MHz, according to an experiment.

Figure 23:
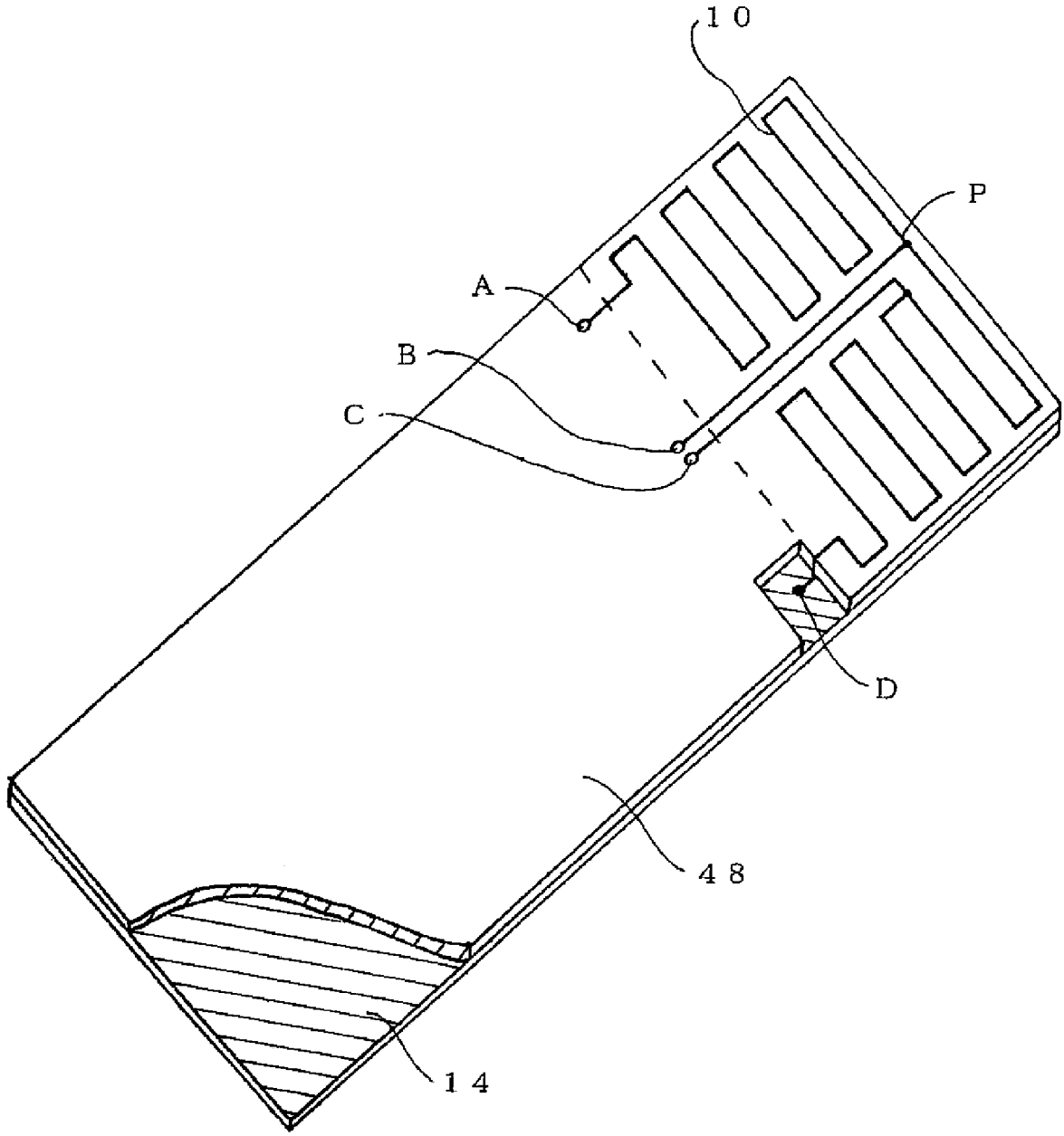
FIG. 23 is an outside perspective view of another concrete example of the antenna for multiple bands of the present invention in which the other end of the antenna element is electrically connected directly to the ground conductor, shown in FIG. 21, on the assumption that the antenna is used in a mobile phone.

FIG. 23 is an outside perspective view of another concrete example of the antenna for multiple bands of the present invention in which the other end D of the antenna element 10 is electrically connected directly to the ground conductor 14, shown in FIG. 21, on the assumption that the antenna is used in a mobile phone. In another example of the antenna shown in FIG. 23, the difference from the example shown in FIG. 22 lies in that the antenna element 10 formed in a meandering pattern turned around repeatedly in a direction parallel to the short sides of the ground conductor 14 is provided in one end of the upper layer of the substrate 48, corresponding to one short side of the ground conductor 14. In this another example shown in FIG. 23, an approximately middle point P of the antenna element is positioned, farthest separated from the ground conductor 14. When the antenna operates with the entire length of the antenna element resonating with a low frequency band of 800 MHz, the approximately middle point P of the antenna element 10 is subjected to the highest voltage, but its coupling is small because of being farthest separated from the ground conductor 14. Thus, it is possible to assume high antenna impedance. When the antenna operates with a part of the antenna element 10 from the feeding point resonating with a relatively high frequency band without using the entire length of the antenna element 10, it is more likely that a point of the antenna element where a high voltage is generated is far separated from the ground conductor 14, as compared with the example shown in FIG. 22, and it is also possible to assume high antenna impedance. According to an experiment by the inventors, a tendency was observed in which the antenna example shown in FIG. 22 has higher gain than another antenna example shown in FIG. 23 at a high frequency band of 1800 MHz and another antenna example shown in FIG. 23 has higher gain than the antenna example shown in FIG. 22 at a low frequency band of 800 MHz.

Figure 24:
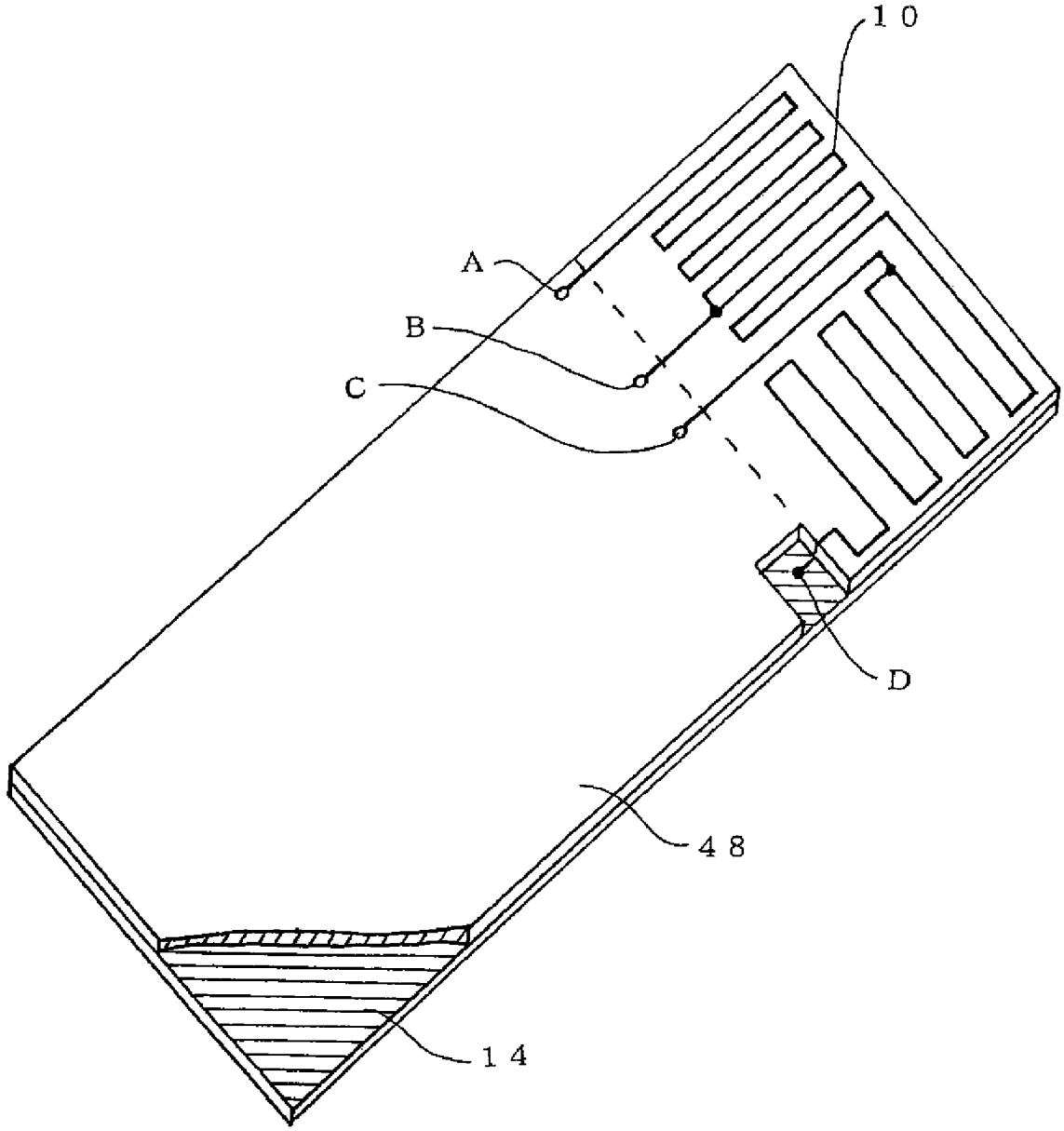
FIG. 24 is an outside perspective view of yet another concrete example of the antenna for multiple bands of the present invention in which the other end of the antenna element is electrically connected directly to the ground conductor, shown in FIG. 21, on the assumption that the antenna is used in a mobile phone.

Then, yet another example of the antenna to which refinement from the tendency known by the above experiment is applied is shown in FIG. 24. FIG. 24 is an outside perspective view of yet another concrete example of the antenna for multiple bands of the present invention in which the other end D of the antenna element 10 is electrically connected directly to the ground conductor 14, shown in FIG. 21, on the assumption that the antenna is used in a mobile phone. In this example shown in FIG. 24, the difference from the examples shown in FIG. 22 and FIG. 23 lines in that a half part of the antenna element 10 from its one end A which is electrically connected to the feeding point is formed in a meandering pattern turned around repeatedly in a direction parallel to the long sides of the ground conductor 14 and the remaining half part of the antenna element up to the other end D which is electrically connected to the ground conductor 14 is formed in a meandering pattern turned around repeatedly in a direction parallel to the short sides of the ground conductor 14. At a high frequency band of 1800 MHz, the half of the antenna element 10 from its one end A, formed in a meandering pattern turned around repeatedly in a direction parallel to the long sides, functions as the antenna having a high gain. At a low frequency band of 800 MHz, the entire length of the antenna element functions as the antenna having a gain which is an average of the gain produced by the antenna element 10 of a meandering pattern shown in FIG. 22 and the gain produced by the antenna element 10 of a meandering pattern shown in FIG. 23. By forming the parts of the antenna element 10 enabling antenna operation in different frequency bands in appropriate meandering patterns, it is possible to adjust the antenna impedance and gain.

While the antenna element 10 shown in FIG. 24 consists of the part of the meandering pattern turned around repeatedly in a direction parallel to the long sides of the ground conductor 14 and the part of the meandering pattern turned around repeatedly in a direction parallel to the short sides, between these two parts, a zigzag meandering pattern turned around in a direction not parallel to both the long and short sides and a non-meandering pattern part may be inserted. The antenna element 10 is not limited to the formation in which the half part of the antenna element 10 from its one end A which is electrically connected to the feeding point is formed in a meandering pattern turned around repeatedly in a direction parallel to the long sides and the remaining half part up to the other end D is formed in a meandering pattern turned around repeatedly in a direction parallel to the short sides. It will be appreciate that a meandering pattern part parallel to the long sides, a meandering pattern part parallel to the short sides, and a non-meandering part may appropriately constitute the antenna element.

Figure 25:
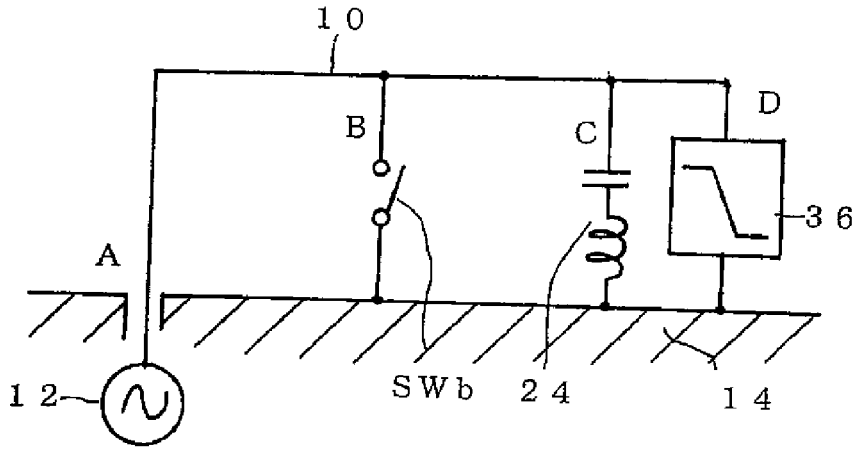
FIG. 25 shows an antenna embodiment in which intermediate points and the other end of the antenna element are electrically connected to the ground conductor via different types of electric circuits, a switch, a series resonant circuit, and a filter.

It is not necessary to electrically connect the intermediate points B, C, and the other end D of the antenna element 10 via any one type of electric circuits such as the switches, series resonant circuits, and filters to the ground conductor 14, as shown in FIGS. 1, 2, and 4. These points and the other end may be connected to the ground conductor 14 via different types of electric circuits; for example, they may be connected via a switch, a series resonant circuit, and a filter, respectively, as is shown in FIG. 25. It will be appreciated that the resonant frequency of a series resonant circuit consisting of a capacitor and a coil is set equal to the resonant frequency of the electrical length of the antenna element up to the point of the connection of that circuit. Likewise, the pass frequency of a filter is set equal to the resonant frequency of the electrical length of the antenna element up to the point of the connection of that circuit. Thus, it is possible to electrically connect the intermediate points B, C, and the other end D of the antenna element 10 to the ground conductor 14 via any of the switches SWb, SWc, and SWd, any of the series resonant circuits 22, 24, and 26, or any of the filters 32, 34, and 36, and there is a high degree of freedom in circuit design.

While, in the eighth embodiment shown in FIG. 8 and the embodiments shown in FIGS. 22, 23, and 24, in any case, the antenna element is formed on the substrate, the antenna element may be formed on a carrier consisting of a dielectric separate from the substrate on which circuits or equivalent are mounted. If the dielectric is made of a high dielectric constant material such as, for example, ceramic, which is used as the carrier, the size of th antenna element can be further reduced. The meandering pattern of the antenna element is not limited to that formed by angular "U" shape turns as in the foregoing embodiments; it may be formed by "V" shape or "U" shape turns or in a zigzag pattern not parallel to both the long and short sides of the ground conductor 14. The meandering turns may not be always made at a constant pitch and may be dense in one section and sparse in another section. A dimension from one turn to the next turn may not be constant.

INDUSTRIAL APPLICABILITY

As described above, the antenna for multiple bands of the present invention is primarily configured such that one end A of the antenna element 10 is electrically connected to the feeding point 12 and the intermediate points B, C and the other end D of the antenna element 10 are electrically connected via the switches SWb, SWc, and SWd, respectively, to the ground conductor 14. The electrical length of the antenna element 10 from the one end A to the intermediate point B plus the connection line from the point B via the switch SWb to the ground conductor 14, the electrical length of the antenna element 10 from the one end A to the intermediate point C plus the connection line from the point C via the switch SWc to the ground conductor 14, and the electrical length of the antenna element 10 from the one end to the other end D plus the connection line from the other end D via the switch SWd to the ground conductor 14 are set to be capable of resonating with different desired frequency bands respectively. By closing one of the switches SWb, SWc, and SWd, one of the desired frequencies can be selected and the antenna can resonate with that frequency. Thus, the antenna employing the single antenna element 10 can operate in multiple frequency bands and its size is easy to reduce. This antenna for multiple bands is ideal for use in a mobile phone and operation in multiple frequency bands.

The invention claimed is:

1. An antenna for multiple bands, characterized in that one end of an antenna element is electrically connected to a feeding point, said antenna element extending longitudinally from the feeding point to the other end thereof to obtain necessary electrical length for antenna operation, one ends of switches are connected respectively to at least one intermediate point and the other end of said antenna element, said intermediate point being a point on the longitudinally extending antenna element, the other end of one of these switches is connected to a ground conductor directly, the other ends of others of these switches are connected respectively to said ground conductor with an extension coil or a short capacitor inserted in series therebetween, different electrical lengths from said feeding point via said switches closed tip to electrical connections to said ground conductor are set to be capable of resonating different desired frequency bands respectively, and resonant frequencies with which different electrical lengths of said antenna element from said feeding point up to the connections to said switches resonate are set not to come close to one of said frequency bands with which the electrical length from said feeding point up to the connection to said ground conductor via any other switch closed resonates.

2. The antenna for multiple bands according to claim 1, characterized in that a matching circuit is inserted between said feeding point and the one end of said antenna element and said electrical lengths including said matching circuit are set.

3. The antenna for multiple bands according to claim 1, characterized in that a capacitor is inserted in series or capacitance is coupled between said feeding point and an intermediate point with the shortest electrical length from said feeding point.

4. The antenna for multiple bands according to claim 1, characterized in that two parallel conductors disconnected in direct current are inserted in series so as to be inductively coupled together between said feeding point and an intermediate point with the shortest electrical length from said feeding point.

5. The antenna for multiple bands according to claim 1, characterized in that said antenna element is formed in a meandering pattern.

6. The antenna for multiple bands according to claim 1, characterized in that said antenna element is formed on the surfaces of a dielectric.

7. The antenna for multiple bands according to claim 1, characterized in that said ground conductor is formed in an approximate rectangle and said antenna element is formed, bordering on one short side of said rectangle, separated from said ground conductor.

8. The antenna for multiple bands according to claim 1, characterized in that said ground conductor is formed in an approximate rectangle on a flat substrate and said antenna element is formed on said substrate, bordering on one short side of said rectangular ground conductor, separated from said ground conductor.

9. The antenna for multiple bands according to claim 1, characterized in that said ground conductor is formed in a rectangle, said antenna element is formed, bordering on one short side of the rectangle, separated from said ground conductor, and said antenna element is formed in a meandering pattern turned around repeatedly in a direction parallel to the long sides of said rectangular ground conductor.

10. The antenna for multiple bands according to claim 1, characterized in that said ground conductor is formed in a rectangle, said antenna element is formed, bordering on one short side of the rectangle, separated from said ground conductor, and said antenna element is formed in a meandering pattern turned around repeatedly in a direction parallel to the short sides of said rectangular ground conductor.

11. The antenna for multiple bands according to claim 1, characterized in that said ground conductor is formed in a rectangle, said antenna element is formed, bordering on one short side of the rectangle, separated from said ground conductor, one part of said antenna element is formed in a meandering pattern turned around repeatedly in a direction parallel to the long sides of said rectangular ground conductor, the remaining part of said antenna element is formed in a meandering pattern turned around repeatedly in a direction parallel to the short sides of said rectangular ground conductor.

12. The antenna for multiple bands according to claim 1, characterized in that said ground conductor is formed in a rectangle, said antenna element is formed, bordering on one short side of the rectangle, separated from said ground conductor, a half part of said antenna element from its one end which is electrically connected to said feeding point is formed in a meandering pattern turned around repeatedly in a direction parallel to the long sides of said rectangular ground conductor, and the remaining half part of said antenna element up to the other end which is electrically connected to said ground conductor is formed in a meandering pattern turned around repeatedly in a direction parallel to the short sides of said rectangular ground conductor.

13. The antenna for multiple bands according to claim 1, characterized in that said antenna element is formed in a meandering pattern along an imaginary circular cylinder plane and one end, the other end, and an intermediate point of said antenna element are positioned so that they are connected to and disconnected from said feeding point and the switches, the series resonant circuits, the parallel resonant circuits, or the filters.

14. The antenna for multiple bands according to claim 1, characterized in that said antenna element is formed in a meandering pattern along an imaginary circular cylinder plane and one end, the other end, and an intermediate point of said antenna element are positioned so that they are connected to and disconnected from said feeding point and the switches, the series resonant circuits, the parallel resonant circuits, or the filters, and, in a casing in which said ground conductor, said feeding point, and the switches, the series resonant circuits, the parallel resonant circuits, or the filters are housed, said antenna element is installed in a position so as to protrude outside and to be removable.

15. An antenna for multiple bands, characterized in that one end of an antenna element is electrically connected to a feeding point said antenna element extending longitudinally from the feeding point to the other end thereof to obtain necessary electrical length for antenna operation, one ends of different series resonant circuits, each comprising a capacitor and a coil, are connected respectively to at least one intermediate point and the other end of said antenna element said intermediate point being a point on the longitudinally extending antenna element, the other ends of these series resonant circuits are connected respectively to a ground conductor with an extension coil or a short inserted in series therebetween, different electrical lengths from said feeding point via said series resonant circuits up to the connections to said ground conductor are set to be capable of resonating different desired frequency bands respectively, the resonant frequency of one series resonant circuit is set equal to one of said frequency bands with which the electrical length from said feeding point up to the connection to said ground conductor via that series resonant circuit resonates, and resonant frequencies with which different electrical lengths of said antenna element from said feeding point up to the connections to said series resonant circuits resonate are set not to come close to one of said frequency bands with which the electrical length from said feeding point up to the connection to said ground conductor via any other series resonant circuit resonates.

16. An antenna for multiple bands, characterized in that one end of an antenna element is electrically connected to a feeding point, one ends of different filters are connected respectively to at least one intermediate point and the other end of said antenna element, the other ends of these filters are connected respectively to a ground conductor with an extension coil or a short capacitor inserted in series therebetween, different electrical lengths from said feeding point via said filters up to the connections to said ground conductor are set to be capable of resonating different desired frequency bands respectively, each of said filters allows passage of one of said frequency bands with which the electrical length from said feeding point via the filter to the connection to said ground conductor resonates and blocks passage of one of said frequency bands with which the electrical length from the feeding point via any other filter to the connection to said ground conductor resonates, and resonant frequencies with which different electrical lengths of said antenna element from said feeding point up to the connections to said filters resonate are set not to come close to one of said frequency bands with which the electrical length from said feeding point via any other filter to the connection to said ground conductor resonates.

17. The antenna for multiple bands according to claim 16, characterized in that said antenna element and said filters are arranged on a dielectric.

18. An antenna for multiple bands, characterized in that one end of an antenna element is electrically connected to a feeding point, one ends of different parallel resonant circuits, each comprising a capacitor and a coil, are connected respectively to one intermediate point and the other end of said antenna element, the other ends of these parallel resonant circuits are connected respectively to a ground conductor with an extension coil or a short capacitor inserted in series therebetween, different electrical lengths from said feeding point via said parallel resonant circuits up to the connections to said ground conductor are set to be capable of resonating different desired frequency bands respectively, the resonant frequency of one parallel resonant circuit connected to said one intermediate point is set equal to one of said frequency bands with which the electrical length from said feeding point via said other end up to the connection to said ground conductor resonates, the resonant frequency of another parallel resonant circuit connected to said other end is set equal to another one of said frequency bands with which the electrical length from said feeding point via said one intermediate point up to the connection to said ground conductor resonates, and resonant frequencies with which different electrical lengths of said antenna element from said feeding point up to the connections to said parallel resonant circuits resonate are set not to come close to one of said frequency bands with which the electrical length from said feeding point up to the connection to said ground conductor via any other parallel resonant circuit resonates.

19. An antenna for multiple bands, characterized in that one end of an antenna element is electrically connected to a feeding point, one ends of any of a switch, a series resonant circuit, comprising a capacitor and a coil, and a filter, which connected respectively to at least one intermediate point and the other end of said antenna element, the other ends of these switch, series resonant circuit, and filter are connected respectively to a ground conductor with an extension coil or a short capacitor inserted in series therebetween, different electrical lengths from said feeding point up to the electrical connections to said ground conductor are set to he capable of resonating different desired frequency bands respectively, the resonant frequency of said series resonant circuit is set equal to one of said frequency hands with which the electrical length from said feeding point up to the connection to said ground conductor via the series resonant circuit resonates, said filter allows passage of one of said frequency bands with which the electrical length from said feeding point via the filter to the connection to said ground conductor resonates and blocks passage of one of said frequency bands with which the electrical length from the feeding point to the connection to said ground conductor without the intervention of the filter resonates, and a resonant frequency with which the electrical length of said antenna element from said feeding point tip to the connection to said switch, said series resonant circuit, or said filter resonates is set not to come close to one of said frequency bands with which the electrical length from said feeding point to the connection to said ground conductor via said switch, said series resonant circuit, or said filter resonates at a different frequency from said resonant frequency.

20. An antenna for multiple bands, characterized in that one end of an antenna element is electrically connected to a feeding point, the other end of said antenna element is electrically connected directly to the ground conductor, one end of any of a switch, a series resonant circuit, comprising a capacitor and a coil, and a filter is connected to at least one intermediate point of said antenna element, the other end of said switch, said series resonant circuit, or said filter is connected to said ground conductor with an extension coil or a short capacitor inserted in series therebetween, different electrical lengths from said feeding point up to the electrical connections to said ground conductor are set to be capable of resonating different desired frequency bands respectively, the resonant frequency of said series resonant circuit is set equal to one of said frequency bands with which the electrical length from said feeding point up to the connection to said ground conductor via the series resonant circuit resonates, said filter allows passage of one of said frequency bands with which the electrical length from said feeding point via the filter to the connection to said ground conductor resonates and blocks passage of one of said frequency bands with which the electrical length from the feeding point to the connection to said ground conductor without the intervention of the filter resonates, and a resonant frequency with which the electrical length of said antenna element from said feeding point up to the connection to said switch, said series resonant circuit, or said filter resonates is set not to come close to one of said frequency bands with which the electrical length from said feeding point to the connection to said ground conductor via said switch, said series resonant circuit, or said filter resonates at a different frequency from said resonant frequency.

* * * * *